US006821092B1

(12) United States Patent
Gehret et al.

(10) Patent No.: US 6,821,092 B1
(45) Date of Patent: Nov. 23, 2004

(54) CAPACITY MODULATED SCROLL COMPRESSOR

(75) Inventors: Natalie Gehret, Yorkshire, OH (US); Kirill Ignatiev, Sidney, OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 10/619,767

(22) Filed: Jul. 15, 2003

(51) Int. Cl.[7] ..... F04B 49/035
(52) U.S. Cl. ..... 417/213; 417/440
(58) Field of Search ..... 417/212, 213, 417/440

(56) References Cited

U.S. PATENT DOCUMENTS

| | | | | |
|---|---|---|---|---|
| 912,866 | A | 2/1909 | Massa | 62/205 |
| 1,942,433 | A | 1/1934 | Lindsay | 417/316 |
| 2,062,052 | A | 11/1936 | Horlacher | 417/293 |
| 2,069,767 | A | 2/1937 | McCormack | 417/310 |
| 2,373,909 | A | 4/1945 | Penn | 417/316 |
| 4,335,582 | A | 6/1982 | Shaw et al. | 62/196.1 |
| 4,431,388 | A | 2/1984 | Eber et al. | 418/55.1 |
| 4,496,296 | A | 1/1985 | Arai et al. | 418/55.5 |
| 4,497,615 | A | 2/1985 | Griffith | 417/310 |
| 4,505,651 | A | 3/1985 | Terauchi et al. | 417/440 |
| 4,575,318 | A | 3/1986 | Blain | 418/14 |
| 4,596,520 | A | 6/1986 | Arata et al. | 418/55.5 |
| 4,610,610 | A | 9/1986 | Blain | 418/14 |
| 4,747,756 | A | 5/1988 | Sato et al. | 417/307 |
| 4,774,816 | A | 10/1988 | Uchikawa et al. | 62/324.1 |
| 4,820,130 | A | 4/1989 | Eber et al. | 417/32 |
| 4,840,545 | A | 6/1989 | Moilanen | 417/301 |
| 4,846,633 | A | 7/1989 | Suzuki et al. | 417/310 |
| 4,877,382 | A | 10/1989 | Caillat et al. | 418/55.5 |
| 4,912,932 | A | 4/1990 | Malaker et al. | 62/6 |
| 4,940,395 | A | 7/1990 | Yamamoto et al. | 417/310 |
| 4,968,232 | A | 11/1990 | Kikuchi | 418/55.5 |
| 5,074,761 | A | 12/1991 | Hirooka et al. | 417/310 |
| 5,076,067 | A | 12/1991 | Prenger et al. | 62/197 |
| 5,102,316 | A | 4/1992 | Caillat et al. | 418/55.5 |
| 5,141,407 | A | 8/1992 | Ramsey et al. | 417/292 |
| 5,156,539 | A | 10/1992 | Anderson et al. | 418/55.4 |
| 5,167,491 | A | 12/1992 | Keller, Jr. et al. | 417/28 |
| 5,169,294 | A | 12/1992 | Barito | 417/310 |
| 5,186,613 | A | 2/1993 | Kotlarek et al. | 417/291 |
| 5,240,389 | A | 8/1993 | Oikawa et al. | 417/310 |
| 5,248,244 | A | 9/1993 | Ho et al. | 417/292 |
| 5,263,822 | A | 11/1993 | Fujio | 418/55.4 |
| 5,290,154 | A | 3/1994 | Kotlarek et al. | 417/292 |
| 5,290,161 | A | 3/1994 | Swain | 418/55.1 |
| 5,293,850 | A | 3/1994 | Nishida | 123/235 |
| 5,320,507 | A | 6/1994 | Monnier et al. | 418/55.6 |
| 5,336,058 | A | 8/1994 | Yokoyama | 417/299 |
| 5,342,185 | A | 8/1994 | Anderson | 418/55.4 |
| 5,342,186 | A | 8/1994 | Swain | 418/55.5 |
| 5,378,129 | A | 1/1995 | Dunaevsky et al. | 418/55.5 |
| 5,411,384 | A | 5/1995 | Bass et al. | 418/55.1 |
| 5,435,707 | A | 7/1995 | Hirano et al. | 418/55.5 |
| RE35,216 | E | 4/1996 | Anderson et al. | 417/310 |
| 5,591,014 | A | 1/1997 | Wallis et al. | 417/310 |
| 5,607,288 | A | 3/1997 | Wallis et al. | 417/310 |
| 5,707,210 | A | 1/1998 | Ramsey et al. | 417/32 |
| 6,120,255 | A * | 9/2000 | Schumann et al. | 417/213 |

FOREIGN PATENT DOCUMENTS

| | | |
|---|---|---|
| JP | 59-117895 | 8/1984 |

* cited by examiner

*Primary Examiner*—John J. Vrablik
(74) *Attorney, Agent, or Firm*—Harness, Dickey & Pierce, P.L.C.

(57) ABSTRACT

A scroll compressor has a biasing chamber which contains a pressurized fluid. The pressurized fluid within the chamber biases the two scroll members together. A valve assembly is in communication with this biasing chamber and releases the pressurized fluid on demand to remove the load, biasing the two scroll members together. When the biasing load is removed, the two scroll members separate, creating a leakage path between discharge and suction to reduce the capacity of the scroll compressor.

76 Claims, 13 Drawing Sheets

CAPACITY MODULATED SCROLL COMPRESSOR

FIELD OF THE INVENTION

The present invention relates to capacity modulation of compressors. More particularly, the present relates to the capacity modulation of a scroll compressor by controlling the fluid pressure in a chamber where the fluid pressure in the chamber biases the two scrolls together.

BACKGROUND AND SUMMARY OF THE INVENTION

Capacity modulation is often a desirable feature to incorporate into the compressors of air conditioning and refrigeration systems in order to better accommodate the wide range of loading to which the systems may be subjected. Many different approaches have been utilized for providing this capacity modulation feature. These approaches have ranged from control of the suction inlet of the compressor to bypassing compressed discharge gas back into the suction pressure zone of the compressor. With a scroll-type compressor, capacity modulation has often been accomplished by using a delayed suction approach which comprises providing ports at various positions along the scroll wrap which, when opened, allow the initially formed compression chambers between the intermeshing scroll wraps to communicate with the suction zone of the compressor, thereby delaying the point at which the sealed compression chambers are formed and, thus, delaying the start of compression of the suction gas. This method of capacity modulation has the effect of actually reducing the compression ratio of the compressor. While these delayed suction systems are effective at reducing the capacity of the compressor, they are only able to provide a predetermined amount of compressor unloading with the amount being determined by the position of the unloading ports along the scroll wraps. While it is possible to provide multiple step unloading by incorporating a plurality of unloading ports at different locations, this approach becomes costly and it requires additional space to accommodate the separate controls for opening and closing each set of ports. Even when using multiple unloading ports, it is typically not possible to control the capacity of the compressor between 0% and 100% using this delayed suction technique.

More recently, compressor unloading and, thus, capacity modulation has been accomplished by cyclically effecting axial or radial separation of the two scroll members for predetermined periods of time during the operating cycle of the compressor. In order to facilitate the axial unloading or axial separation of the two scroll members, a biasing chamber is formed in or adjacent one of the two scroll members; and this biasing chamber is placed in communication with a source of compressed fluid in a pressure chamber or the discharge chamber of the compressor. The fluid in the biasing chamber is cyclically released to the suction area of the compressor to facilitate the unloading of the compressor.

While the prior art devices have performed satisfactorily in the field, their designs have required the addition of the specific biasing chamber, as well as the control systems needed to control the flow of the pressurized fluid.

The continued development of capacity modulated scroll compressors has been directed towards the simplification of the capacity modulation devices in order to lower the costs of the capacity modulated systems, as well as simplifying the overall manufacture, design and development of these capacity modulated systems.

The present invention provides the art with a capacity modulated compressor which vents an existing intermediate pressurized chamber cyclically to suction to modulate the capacity of the compressor. The existing intermediate pressurized chamber is utilized in the compressor to bias the two scrolls together as well as to bias a floating seal into contact with a partition or the shell to seal a leakage passage between discharge pressure and the suction pressure zone of the compressor.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
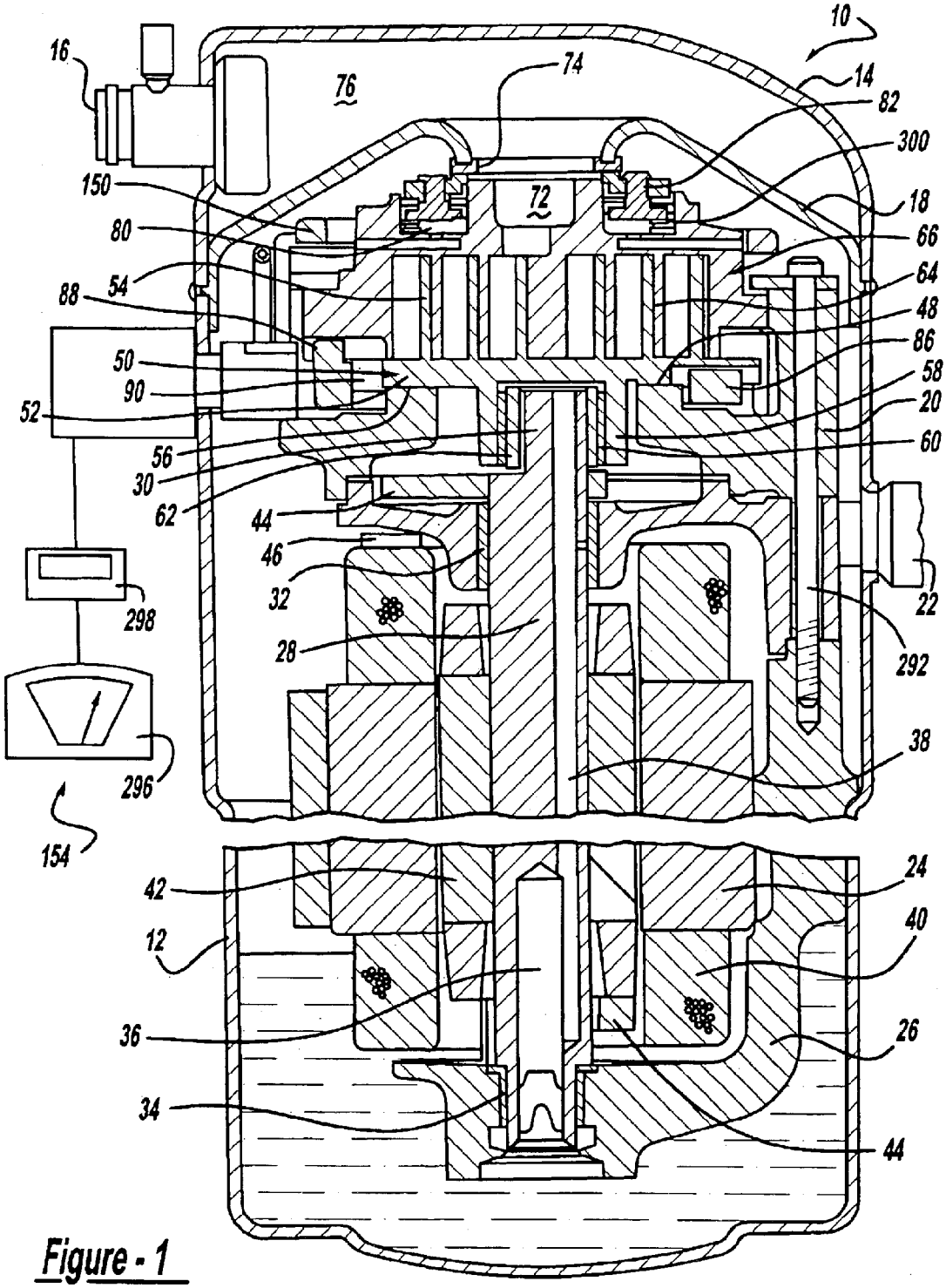
FIG. 1 is a vertical section view of a scroll-type compressor incorporating a capacity modulation system in accordance with the present invention.

The following description of the preferred embodiment(s) is merely exemplary in nature and is in no way intended to limit the invention, its application, or uses.

While the present invention is suitable for incorporation in many different types of scroll machines, including hermetic machines, open drive machines and non-hermetic machines, for exemplary purposes it will be described herein incorporated in a hermetic scroll refrigerant motor-compressor 10 of the "low side" type (i.e., where the motor and compressor are cooled by suction gas in the hermetical shell, as illustrated in the vertical section shown in FIG. 1). Generally speaking, compressor 10 comprises a cylindrical hermetic shell 12 which includes at the upper end thereof an end cap 14. End cap 14 is provided with a refrigerant discharge fitting 16 optionally having the usual discharge valve therein. Other elements affixed to the shell include a transversely extending partition 18 which is welded about its periphery at the same point that end cap 14 is welded to shell 12, a two-piece main bearing housing 20 which is affixed to shell 12 at a plurality of points in any desirable manner, and a suction gas inlet fitting 22 disposed in communication with the suction pressure zone of compressor 10 inside shell 12.

A motor stator 24 is press fit into a frame 26 which is in turn press fit into shell 12. A crankshaft 28 having an eccentric crank pin 30 at the upper end thereof is rotatably journaled in a bearing 32 in main bearing housing 20 and a second bearing 34 in frame 26. Crankshaft 28 has at the lower end the usual relatively large diameter oil-pumping concentric bore 36 which communicates with a radially outwardly inclined smaller diameter bore 38 extending upwardly therefrom to the top of crankshaft 28. The lower portion of the interior shell 12 is filled with lubricating oil in the usual manner and concentric bore 36 at the bottom of crankshaft 28 is the primary pump acting in conjunction with bore 38, which acts as a secondary pump, to pump lubricating fluid to all the various portions of compressor 10 which require lubrication.

Crankshaft 28 is rotatively driven by an electric motor including stator 24 having windings 40 passing therethrough, and a rotor 42 press fit on crankshaft 28 and having one or more counterweights 44. A motor protector 46, of the usual type, is provided in close proximity to motor windings 40 so that if the motor exceeds its normal temperature range motor protector 46 will de-energize the motor.

The upper surface of main bearing housing 20 is provided with an annular flat thrust bearing surface 48 on which is disposed an orbiting scroll member 50 comprising an end plate 52 having the usual spiral vane or wrap 54 on the upper surface thereof, an annular flat thrust surface 56 on the lower surface, and projecting downwardly therefrom a cylindrical hub 58 having a journal bearing 60 therein and in which is rotatively disposed a drive bushing 62 having an inner bore in which crank pin 30 is drivingly disposed. Crank pin 30 has a flat on one surface (not shown) which drivingly engages a flat surface in a portion of the inner bore of drive bushing 62 to provide a radially compliant driving arrangement, such as shown in assignee's U.S. Pat. No. 4,877,382, the disclosure of which is herein incorporated by reference.

Wrap 54 meshes with a non-orbiting spiral wrap 64 forming a part of non-orbiting scroll member 66 which is mounted to main bearing housing 20 in any desired manner which will provide limited axial movement of scroll member 66. The specific manner of such mounting is not relevant to the present inventions. For a more detailed description of the non-orbiting scroll suspension system, see assignee's U.S. Pat. No. 5,055,010, the disclosure of which is hereby incorporated herein by reference.

Non-orbiting scroll member 66 has a centrally disposed discharge passageway communicating with an upwardly open recess 72 which is in fluid communication via an opening 74 in partition 18 with a discharge muffler chamber 76 defined by end cap 14 and partition 18. A pressure relief valve is disposed between the discharge muffler chamber 76 and the interior of shell 12. The pressure relief valve will open at a specified differential pressure between the discharge and suction pressures to vent pressurized gas from the discharge muffler chamber 76. Non-orbiting scroll member 66 has in the upper surface thereof an annular recess 80 having parallel coaxial side walls in which is sealingly disposed for relative axial movement an annular floating seal 82 which serves to isolate the bottom of recess 80 from the presence of gas under suction and discharge pressure so that it can be placed in fluid communication with a source of intermediate fluid pressure by means of a passageway 84 (not shown). Non-orbiting scroll member 66 is thus axially biased against orbiting scroll member 50 by the forces created by discharge pressure acting on the central portion of scroll member 66 and those created by intermediate fluid pressure acting on the bottom of recess 80. This axial pressure biasing, as well as various techniques for supporting scroll member 66 for limited axial movement, are disclosed in much greater detail in assignee's aforesaid U.S. Pat. No. 4,877,328.

Relative rotation of the scroll members is prevented by the usual Oldham coupling comprising a ring 86 having a first pair of keys 88 (one of which is shown) slidably disposed in diametrically opposed slots 90 (one of which is shown) in scroll member 66 and a second pair of keys (not shown) slidably disposed in diametrically opposed slots in scroll member 50.

Figure 2:
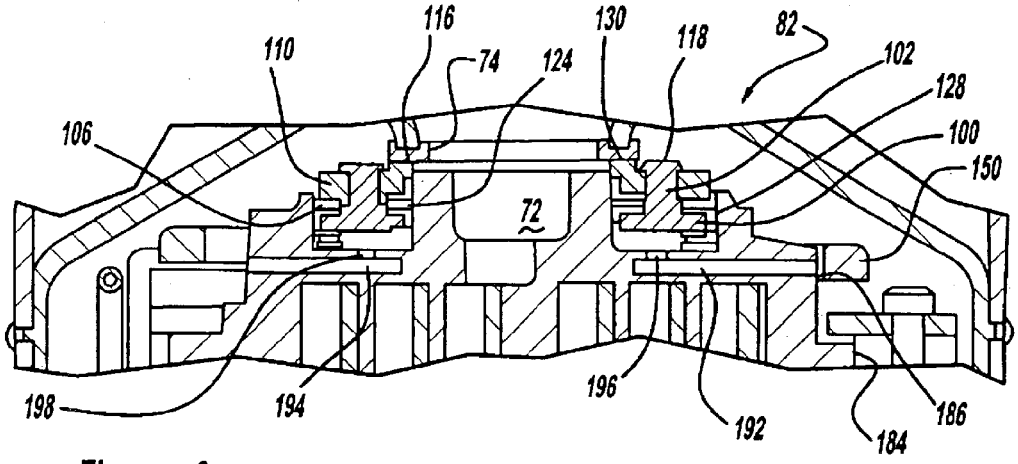
FIG. 2 is a fragmentary view of the compress of FIG. 1 showing the valving ring in a closed or unmodulated position.

Referring now to FIG. 2. Although the details of construction of floating seal 82 are not part of the present invention, for exemplary purposes seal 82 is of a coaxial sandwiched construction and comprises an annular base plate 100 having a plurality of equally spaced upstanding integral projections 102. Disposed on plate 100 is an annular gasket 106 having a plurality of equally spaced holes which receive projections 102. On top of gasket 106 is disposed an upper seal plate 110 having a plurality of equally spaced holes which receive projections 102. Seal plate 110 has disposed about the inner periphery thereof an upwardly projecting planar sealing lip 116. The assembly is secured together by swaging the ends of each of the projections 102, as indicated at 118.

The overall seal assembly therefore provided three distinct seals; namely, an inside diameter seal at 124, an outside diameter seal at 128 and a top seal at 130. Seal 124 is between the inner periphery of gasket 106 and the inside wall of recess 80. Seal 124 isolates fluid under intermediate pressure in the bottom of recess 80 from fluid under discharge pressure in recess 72. Seal 128 is between the outer periphery of gasket 106 and the outer wall of recess 80, and isolates fluid under intermediate pressure in the bottom of recess 80 from fluid at suction pressure within shell 10. Seal 130 is between sealing lip 116 and an annular wear ring surrounding opening 74 in partition 18, and isolates fluid at suction pressure from fluid at discharge pressure across the top of the seal assembly. The details of the construction of seal 82 is similar to that described in U.S. Pat. No. 5,156,539, the disclosure of which is hereby incorporated herein by reference.

The compressor is preferably the "low side" type in which suction gas entering gas inlet fitting 22 is allowed, in part, to escape into shell 12 and assist in cooling the motor. So long as there is an adequate flow of returning suction gas the motor will remain within desired temperature limits. When this flow drops significantly, however, the loss of cooling will eventually cause motor protector 46 to trip and shut the machine down.

As thus far described, scroll compressor 10 is typical of such scroll-type refrigeration compressors. In operation, suction gas directed to the lower chamber via suction gas inlet fitting 22 is drawn into the moving fluid pockets as orbiting scroll member 50 orbits with respect to non-orbiting scroll member 66. As the moving fluid pockets move inwardly, this suction gas is compressed and subsequently discharged into muffler chamber 76 via upwardly open recess 72 in non-orbiting scroll member 66 and discharge opening 74 in partition 18. Compressed refrigerant is then supplied to the refrigeration system via discharge fitting 16.

In selecting a refrigeration compressor for a particular application, one would normally choose a compressor having sufficient capacity to provide adequate refrigerant flow for the most adverse operating conditions to be anticipated for that application and may select a slightly larger capacity top provide an extra margin of safety. However, such "worst case" adverse conditions are rarely encountered during actual operation and thus this excess capacity of the compressor results in operation of the compressor under lightly loaded conditions for a high percentage of its operating time. Such operation results in reducing overall operating efficiency of the system. Accordingly, in order to improve the overall operating efficiency under generally encountered operating conditions while still enabling the refrigeration compressor to accommodate the "worse case" operating conditions, compressor 10 is provided with a capacity modulation system. The capacity modulation system allows the compressor to operate at the capacity required to meet the requirements of the system.

The capacity modulation system includes an annular valving ring 150 movably mounted on non-orbiting scroll member 66, an actuating assembly 152 supported within shell 12 and a control system 154 for controlling operation of the actuating assembly.

As best seen with reference to FIGS. 2 and 5 through 7, valving ring 150 comprises a generally circular shaped main body portion 156 having a pair of substantially diametrically opposed radially inwardly extending protrusions 158 and 160 provided thereon of substantially identical predetermined axial and circumferential dimensions. Suitable substantially identical circumferentially extending guide surfaces 162, 164 and 166, 168 are provided adjacent axially opposite sides of protrusions 158 and 160, respectively. Additionally, two pairs of substantially identical circumferentially extending axially spaced guide surfaces 170, 172 an 174, 176 are provided on main body 156 being positioned in substantially diametrically opposed relationship to each other and spaced circumferentially approximately 90° from respective protrusions 158 and 160. As shown, guide surfaces 172 and 174 project radially inwardly slightly more from main body 156 as do guide surfaces 162 and 166. Preferably, guide surfaces 172, 174 and 162, 166 are all axially aligned and lie along the periphery of a circle of a radius slightly less than the radius of main body 156. Similarly, guide surfaces 170 and 176 project radially inwardly slightly more from main body 156 as do guide surfaces 164 and 168 with which they are preferably axially aligned. Also surfaces 170, 176 and 164, 168 lie along the periphery of a circle of a radius slightly less than the radius of main body 156 and preferably substantially equal to the radius of the circle along which surfaces 172, 174 and 162, 166 lie. Main body 156 also includes a circumferentially extending stepped portion 178 which includes an axially extending circumferentially facing stop surface 180 at one end. Step portion 178 is positioned between protrusion 160 and guide surfaces 170, 172. A pin member 182 is also provided extending axially upwardly adjacent one end of stepped portion 178. Valving ring 150 may be fabricated from a suitable metal such as aluminum or alternatively may be formed from a suitable polymeric composition and pin 182 may be either pressed into a suitable opening provided therein or integrally formed therewith.

Figure 3:
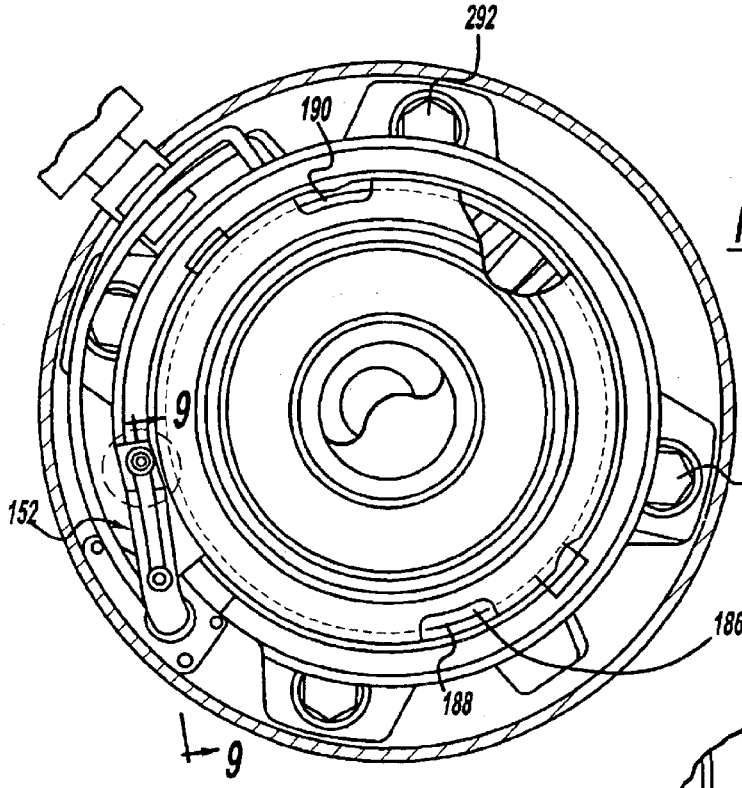
FIG. 3 is a plan view of the compressor shown in FIG. 1 with the top portion of the outer shell removed.

As previously mentioned, valving ring 150 is designed to be movably mounted on non-orbiting scroll member 66. In order to accommodate valving ring 150, non-orbiting scroll member 66 includes a radially outwardly facing cylindrical sidewall portion 184 thereon having an annular groove 186 formed therein adjacent the upper end thereof. In order to enable valving ring 150 to be assembled to non-orbiting scroll member 66, a pair of diametrically opposed substantially identical radially inwardly extending notches 188 and 190 are provided in non-orbiting scroll member 66 each opening into groove 186 as best seen with reference to FIG. 3. Notches 188 and 190 have a circumferentially extending dimension slightly larger than the circumferential extent of protrusions 158 and 160 on valving ring 150.

Groove 186 is sized to movably accommodate protrusions 158 and 160 when valving ring is assembled thereto and notches 188 and 190 are sized to enable protrusions 158 and 160 to be moved into groove 186. Additionally, cylindrical portion 184 will have a diameter such that guide surfaces 162, 164, 166, 168, 170, 172, 174 and 176 will slidingly support rotary movement of valving ring 150 with respect to non-orbiting scroll member 66.

Non-orbiting scroll member 66 also includes a pair of generally diametrically opposed radially extending passages 192 and 194 opening into the inner surface of groove 186 and extending generally radially inwardly through the end plate of non-orbiting scroll member 66. An axially extending passage 196 places the inner end of passage 192 in fluid communication with annular recess 80 while a second axially extending passage 198 places the inner end of passage 194 in fluid communication with annular recess 80.

Figure 9:
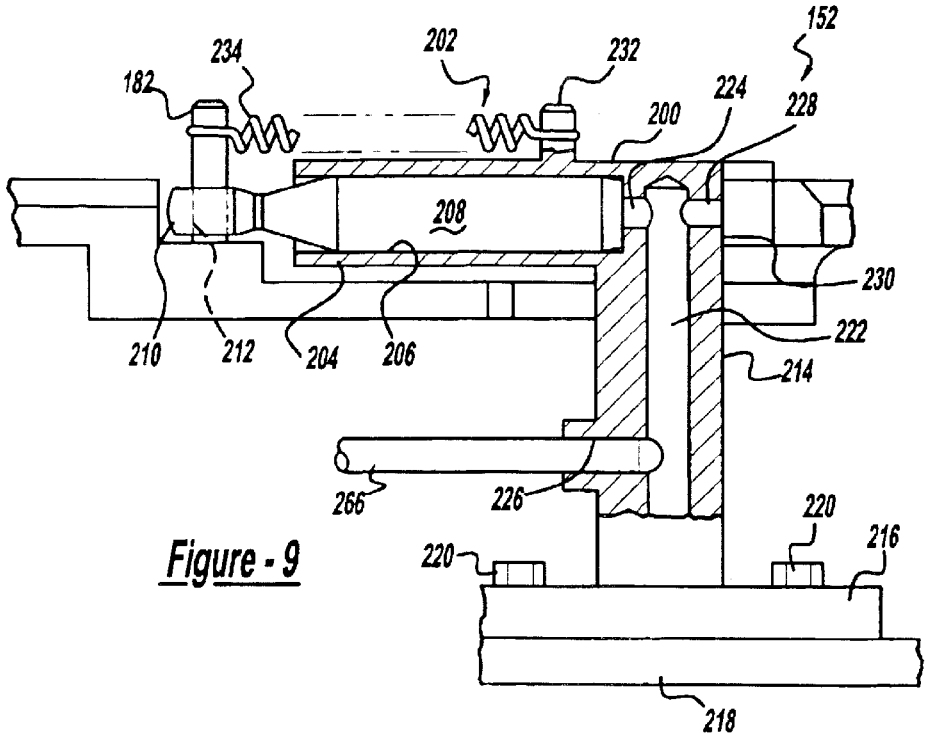
FIG. 9 is an enlarged detailed view of the actuating assembly incorporated in the compressor of FIG. 1.

As best seen with reference to FIG. 9, actuating assembly 152 includes a piston and cylinder assembly 200 and a return spring assembly 202. Piston and cylinder assembly 200 includes a housing 204 having a bore defining a cylinder 206 extending inwardly from one end thereof and within which a piston 208 is movably disposed. An outer end 210 of piston 208 projects axially outwardly from one end of housing 204 and includes an elongated or oval-shaped opening 212 therein adapted to receive pin 182 forming a part of valving ring 150. Elongated or oval opening 212 is designed to accommodate the arcuate movement of pin 182 relative to the linear movement of piston end 210 during operation. A depending portion 214 of housing 204 has secured thereto a suitably sized mounting flange 216 which is adapted to enable housing 204 to be secured to a suitable flange member 218 by bolts 220. Flange 218 is in turn suitably supported within outer shell 12 such as by bearing housing 20.

A passage 222 is provided in depending portion 214 extending upwardly from the lower end thereof and opening into a laterally extending passage 224 which in turn opens into the inner end of cylinder 206. A second laterally extending passage 226 provided in depending portion 214 opens outwardly through the sidewall thereof and communicates at its inner end with passage 222. A second relatively small laterally extending passage 228 extends from fluid passage 222 in the opposite direction of fluid passage 224 and opens outwardly through an end wall 230 of housing 204.

A pin member 232 is provided upstanding from housing 204 to which is connected one end of a return spring 234 the other end of which is connected to an extended portion of pin 182. Return spring 234 will be of such a length and strength as to urge ring 150 and piston 208 into the position shown in FIG. 9 when cylinder 206 is fully vented via passage 228.

Figure 10:
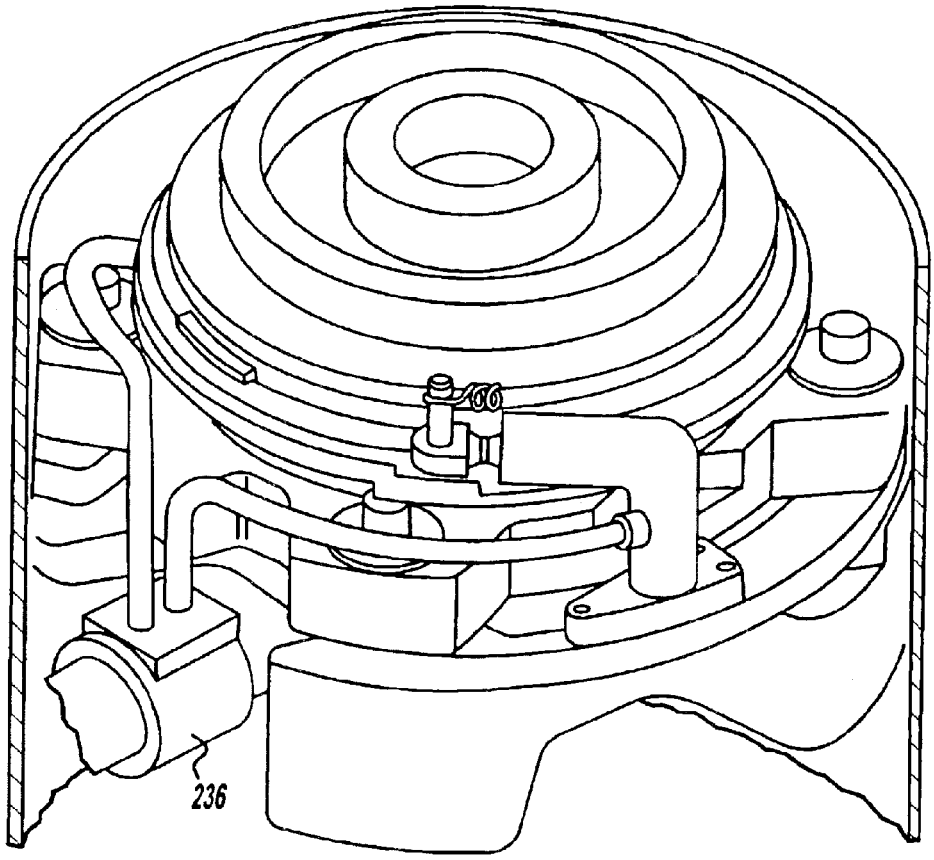
FIG. 10 is a perspective view of the compressor of FIG. 1 with portions of the outer shell broken away.
Figure 12:
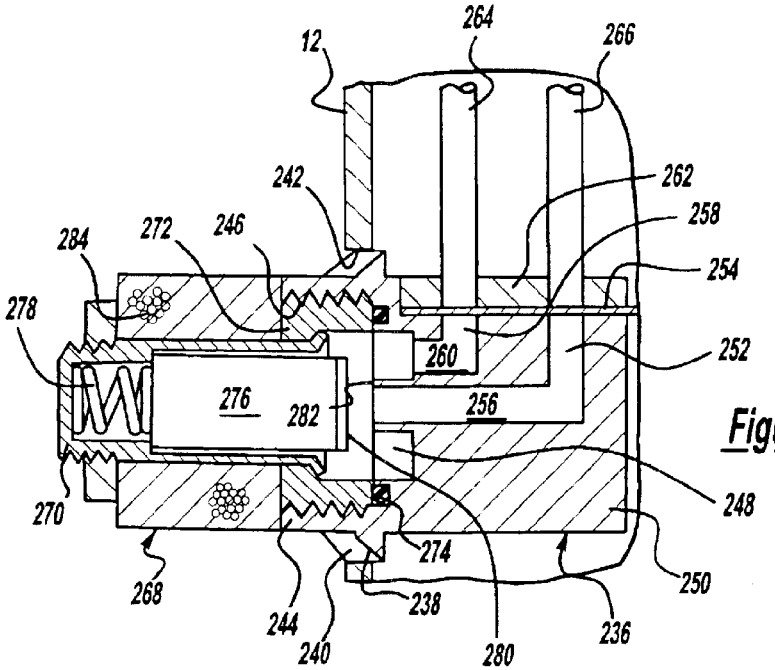
FIG. 12 is an enlarged section view of the solenoid valve assembly incorporated in the compressor of FIG. 1.

As best seen with references to FIGS. 1, 10 and 12, control system 154 includes a valve body 236 having a radially outwardly extending flange 238 including a conical surface 240 on one side thereof. Valve body 236 is inserted into an opening 242 in outer shell 12 and positioned with conical surface 240 abutting the peripheral edge of opening 242 and then welded to shell 12 with a cylindrical portion 244 projecting outwardly therefrom. Cylindrical portion 244 of valve body 236 includes an enlarged diameter threaded bore 246 extending axially inwardly and opening into a recess area 248.

Valve body 236 includes a housing 250 having a first passage 252 extending downwardly from a substantially flat upper surface 254 and intersecting a second laterally extending passage 256 which opens outwardly into the area of opening 242 in shell 12. A third passage 258 also extends downwardly from surface 254 and intersects a fourth laterally extending passage 260 which also opens outwardly into recessed area 248 provided in the end portion of body 236.

A manifold 262 is sealingly secured to surface 254 by means of suitable fasteners and includes fittings for connection of one end of each of fluid lines 264 and 266 so as to place them in sealed fluid communication with respective passages 258 and 252.

A solenoid coil assembly 268 is designed to be sealingly secured to valve body 236 and includes an elongated tubular member 270 having a threaded fitting 272 sealingly secured to the open end thereof. Threaded fitting 272 is adapted to be threadedly received within bore 246 and sealed thereto by means of an O-ring 274. A plunger 276 is movably disposed within tubular member 270 and is biased outwardly therefrom by a spring 278 which bears against a closed end of tubular member 270. A valve member 280 is provided on the outer end of plunger 276 and cooperates with a valve seat 282 to selectively close off passage 256. A solenoid coil 284 is positioned on tubular member 270 and secured thereto by means of a nut threaded on the outer end of tubular member 270.

Figure 11:
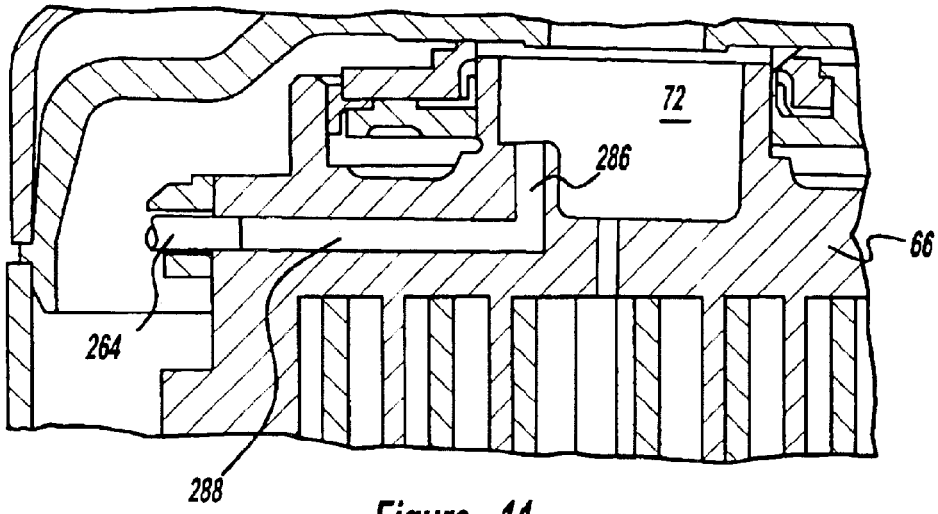
FIG. 11 is a fragmentary section view of the compressor of FIG. 1 showing the pressurized fluid supply passages provided in the non-orbiting scroll.

In order to supply pressurized fluid to actuating assembly 152, an axially extending passage 286 extends downwardly from open recess 72 and connects to a generally radially extending passage 288 in non-orbiting scroll member 66. Passage 288 extends radially and opens outwardly through the circumferential sidewall of non-orbiting scroll 66 as best seen with reference to FIG. 11. The other end of fluid line 264 is sealingly connected to passage 288 whereby a supply of compressed fluid may be supplied from open recess 72 to valve body 236. A circumferentially elongated opening 290 is provided in valving ring 150 suitably positioned so as to enable fluid line 264 to pass therethrough while accommodating the rotational movement of ring 150 with respect to non-orbiting scroll member 66.

In order to supply pressurized fluid from valve body 236 to actuating piston and cylinder assembly 200, fluid line 266 extends from valve body 236 and is connected to passage 226 provided in depending portion 214 of housing 204.

Valving ring 150 may be easily assembled to non-orbiting scroll member 66 by merely aligning protrusions 158 and 160 with respective notches 188 and 190 and moving protrusions 158 and 160 into annular groove 186. Thereafter valving ring 150 is rotated into the desired position with the axially upper and lower surfaces of protrusions 158 and 160 cooperating with guide surfaces 162, 164, 166, 168, 170, 172, 174 and 176 to movably support valving ring 150 on non-orbiting scroll member 66. Thereafter, housing 204 of actuating assembly 152 may be positioned on mounting flange 218 with piston end 210 receiving pin 182. One end of spring 234 may then be connected to pin 232 thereafter, the other end of spring 234 may be connected to pin 182 thus completing the assembly process.

Figure 4:
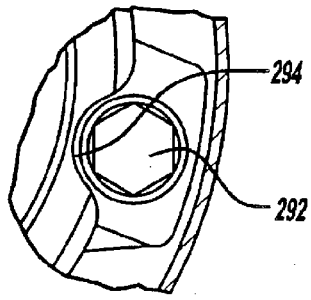
FIG. 4 is an enlarged view showing a portion of a modified valving ring.
Figure 5:
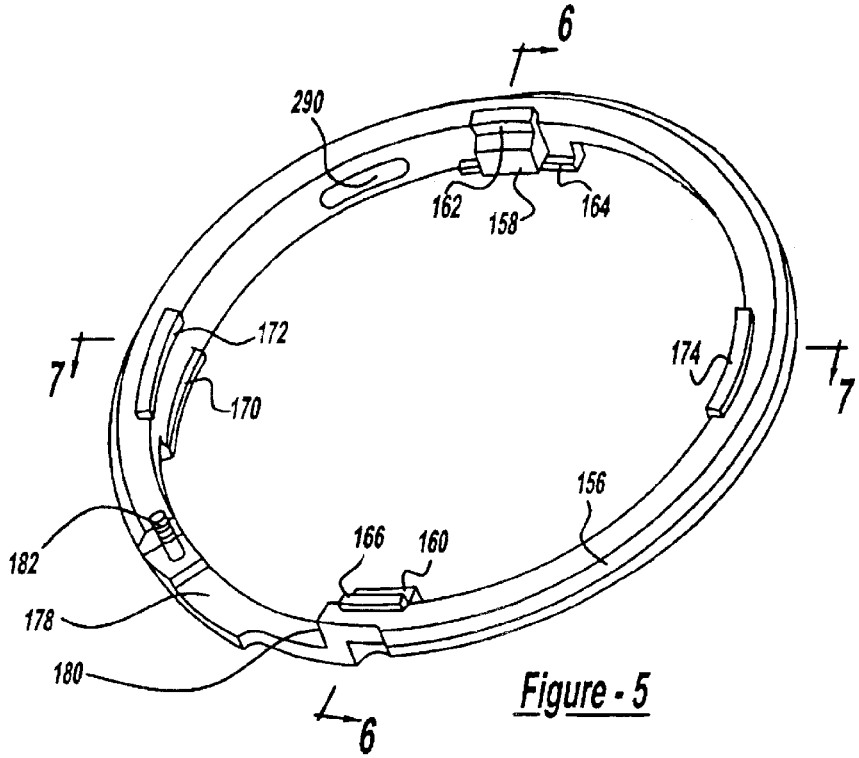
FIG. 5 is a perspective view of the valving ring incorporated in the compressor of FIG. 1.
Figure 6:
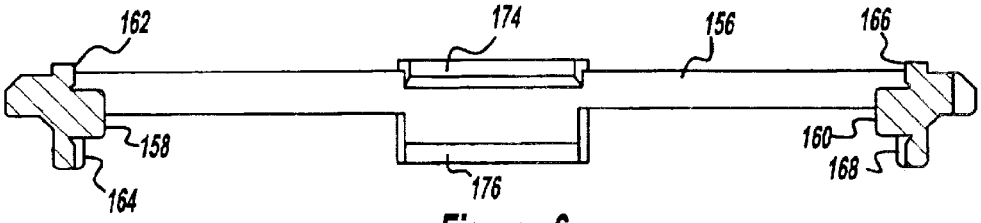
FIGS. 6 and 7 are section views of the valving ring of FIG. 4, the sections being taken along lines 6—6 and 7—7 respectively.
Figure 7:
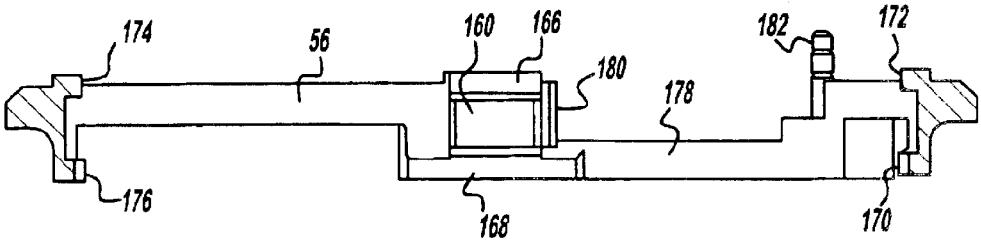
Figure 8:
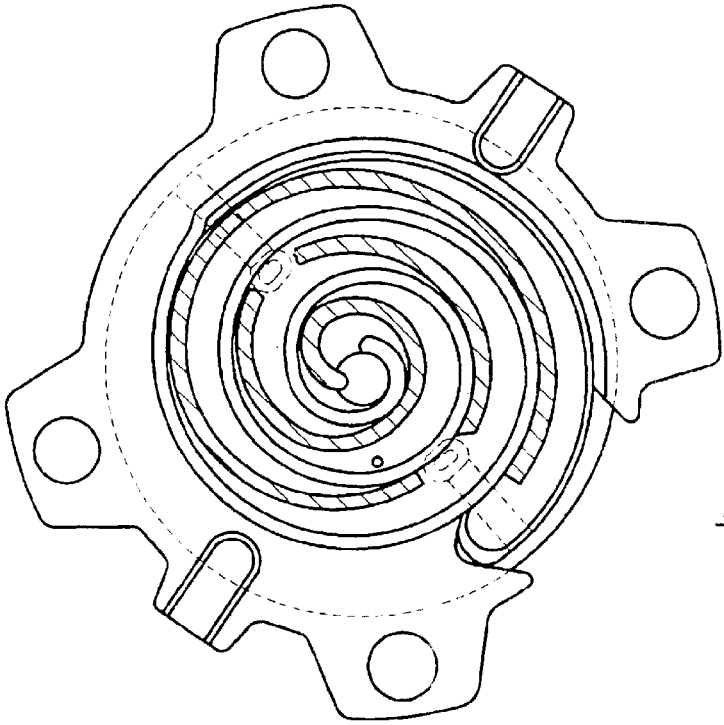
FIG. 8 is a fragmentary section view showing the scroll assembly forming a part of the compressor of FIG. 1.

While non-orbiting scroll member 66 is typically secured to main bearing housing 20 by suitable bolts 292 prior to assembly of valving ring 150, it may in some cases be preferable to assemble this continuous capacity modulation component to non-orbiting scroll member 66 prior to assembly of non-orbiting scroll member 66 to main bearing housing 20. This may be easily accomplished by merely providing a plurality of suitably positioned arcuate cutouts 294 along the periphery of valving ring 150 as shown in FIG. 4 these cutouts will afford access to securing bolts 292 with valving ring assembled to non-orbiting scroll member 66.

In operation, when system operating conditions as sensed by one or more sensors 296 indicate that full capacity of compressor 10 is required, control module 298 will operate in response to a signal from sensors 296 to energize solenoid coil 284 of solenoid assembly 268 thereby causing plunger 276 to be moved out of engagement with valve seat 282 thereby placing passages 256 and 260 in fluid communication. Pressurized fluid at substantially discharge pressure will then be allowed to flow from open recess 72 to cylinder 206 via passages 286, 288 fluid line 264, passages 258, 260, 256, 252 fluid line 266 and passages 226, 222 and 224. This fluid pressure will then cause piston 208 to move outwardly with respect to cylinder 206 thereby rotating valving ring 150 so as to move protrusions 158 and 160 into sealing overlying relationship to passages 192 and 194. This will then prevent intermediate pressurized gas disposed within recess 80 from being exhausted or vented through passages 192 and 194. Compressor 10 will then operate at its full capacity.

When the load conditions change to the point that the full capacity of compressor 10 is not required, sensors 296 will provide a signal indicate thereof to controller 298 which in turn will deenergize coil 284 of solenoid assembly 268. Plunger 276 will then move outwardly from tubular member 270 under the biasing action of spring 278 thereby moving valve member 280 into sealing engagement with seat 282 thus closing off passage 256 and the flow of pressurized fluid therethrough. It is noted that recessed area 248 will be in continuous fluid communication with open recess 72 and hence continuously subject to discharge pressure. This discharge pressure will aid in biasing valve member 280 into fluid tight sealing engagement with valve seat 282 as well as retaining same in such relationship.

The pressurized gas contained in cylinder 206 will bleed back into the suction zone of compressor 10 via vent passage 228 thereby enabling spring 234 to rotate valving ring 150 back to a position in which passages 192 and 194 are no longer closed off by protrusions 158 and 160. Spring 234 will also move piston 208 inwardly with respect to cylinder 206. In this position, the intermediate pressure within annular recess 80 will be exhausted or vented through passages 192 and 194. The venting of the intermediate pressurized fluid removes the biasing force urging non-orbiting scroll member 66 into sealing engagement with orbiting scroll member 50 to create a leak between the discharge pressure zone and the suction pressure zone. This leak causes the capacity of compression 10 to move to zero capacity. A spring 300 urges floating seal 82 upwards and maintains the sealing relationship at top seal 130.

It should be noted that the speed with which valving ring 150 may be moved between the modulated position and the unmodulated position will be directly related to the relative size of vent passage 228 and the supply lines. In other words, because passage 228 is continuously open to the suction pressure zone of compressor 10, when coil 284 of solenoid assembly 268 is energized a portion of the pressurized fluid flowing from open recess 72 will be continuously vented to suction pressure. The volume of this fluid will be controlled by the relative sizing of passage 228. However, as passage 228 is reduced in size, the time required to vent cylinder 206 will increase thus increasing the time required to switch from reduced capacity to full capacity.

Figure 13:
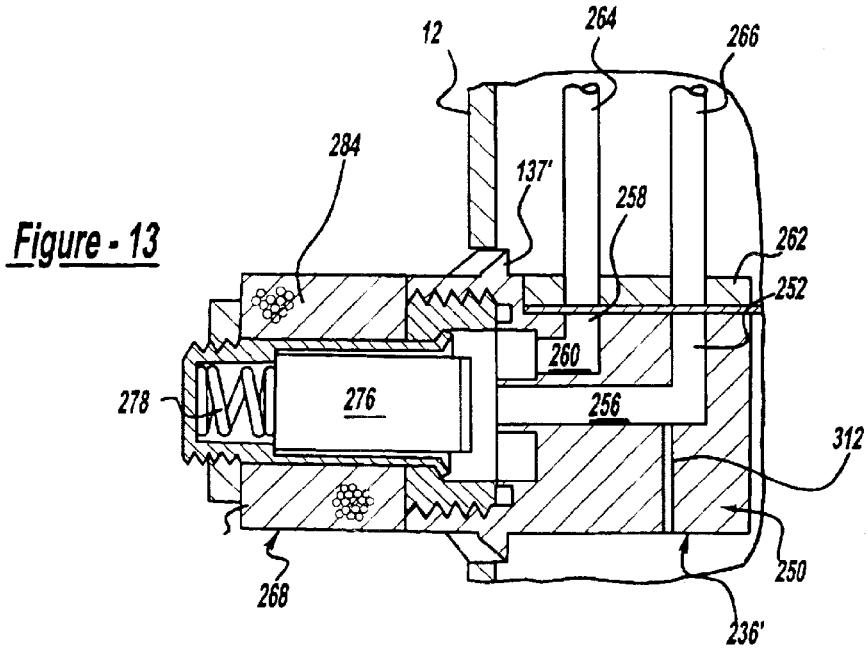
FIG. 13 is a view similar to that of FIG. 12 but showing a modified solenoid valve assembly.
Figure 14:
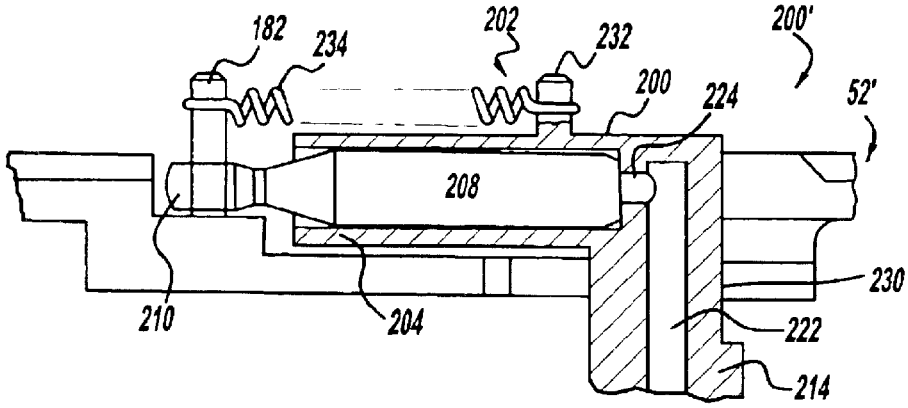
FIG. 14 is a view similar to that of FIG. 9 but showing a modified actuating assembly adapted for use with the solenoid valve assembly of FIG. 13.

While the above embodiment has been described utilizing a passage 228 provided in housing 204 to vent actuating pressure from cylinder 206 to thereby enable compressor 10 to return to reduced capacity, it is also possible to delete passage 228 and incorporate a vent passage in the valve body 236 in place thereof. Such an embodiment is shown in FIGS. 13 and 14. FIG. 13 shows a modified valve body 236' incorporating a vent passage 312 which will operate to continuously vent passage 252 to suction pressure and hence allow cylinder 206 to vent to suction via line 266. FIG. 14 in turn shows a modified piston and cylinder assembly 200' in which vent passage 228 has been deleted. The operation and function of valve body 236' and piston cylinder assembly 200' will otherwise be substantially identical to that disclosed above. Accordingly, corresponding portions of valve bodies 236 and 236', piston and cylinder assemblies 200 and 200' are substantially identical and have each been indicated by the same reference numbers.

Figure 15:
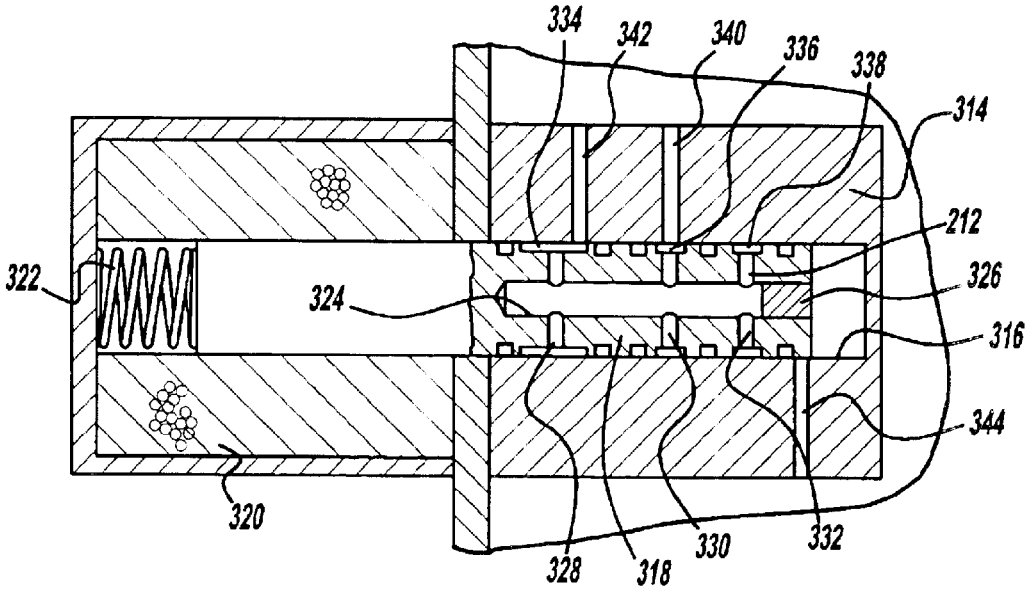
FIG. 15 is a view similar to that of FIGS. 12 and 13 but showing another embodiment of the solenoid valve assembly, all in accordance with the present invention.

While the above embodiments provide efficient relatively low cost arrangements for capacity modulation, it is also possible to utilize a three way solenoid valve in which the venting of cylinder 206 is also controlled by valving. Such an arrangement is illustrated and will be described with reference to FIG. 15. In this embodiment, a valve body 314 is secured to shell 12 in the same manner as described above and includes an elongated central bore 316 within which is movably disposed a spool valve 318. Spool valve 318 extends outwardly through shell 12 into solenoid coil 320 and is adapted to be moved longitudinally outwardly from valve body 314 upon energization of solenoid coil 320. A coil spring 322 operates to bias spool valve 318 into valve body 314 when coil 320 is not energized.

Spool valve 318 includes an elongated axially extending central passage 324 the inner end of which is plugged via plug 326. Three groups of generally radially extending axially spaced passages 328, 330, 332 are provided, each group consisting of one or more such passages which extend outwardly from central passages 324 with each group opening into axially spaced annular grooves 334, 336 and 338 respectively. Valve body 314 in turn is provided with a first high pressure supply passage 340 which opens into bore 316 and is adapted to be connected to fluid line 264 to supply compressed fluid to valve body 314. A second passage 342 in valve body also opens into bore 316 and is adapted to be connected to fluid line 266 at its outer end to place bore 316 in fluid communication with cylinder 206. A vent passage 344 is also provided in valve body 314 having one end opening into bore 316 with the other end opening into the suction pressure zone of shell 12.

In operation, when solenoid coil is deenergized, spool valve 318 will be in a position such that annular groove 334 will be in open communication with passage 342 and annular groove 338 will be in open communication with vent passage 344 thereby continuously venting cylinder 206. At this time, spool valve 318 will be positioned such that annular seals will lie on axially opposite sides of passage 340 thereby preventing flow of compressed fluid from open recess 72. When it is desired to actuate the capacity modulation system to increase the capacity of compressor 10, solenoid coil 320 will be energized thereby causing spool valve 318 to move outwardly from valve body 314. This will result in annular groove 338 moving out of fluid communication with vent passage 344 while annular groove 336 is moved into open communication with high pressure supply passage 340. As passage 342 will remain in fluid communication with annular groove 334, pressurized fluid from passage 340 will be supplied to cylinder 206 via passages 330 and 328 in spool valve 318. Additional suitable axially spaced annular seals will also be provided on spool valve 318 to ensure a sealing relationship between spool valve 318 and bore 316.

As detailed above, the capacity modulation system can control the capacity of compressor 10 to be 100% capacity or it can be zero capacity. Also, by controlling the capacity modulation system detailed above using a pulsed width modulation system, the capacity of compressor 10 can be set at any point between zero capacity and 100% capacity to provide complete control of compressor 10. For example, pulsed width modulation control for solenoid coil assembly 268 will provide the capacity control for compressor 10 anywhere between zero percent and 100%.

Figure 16:
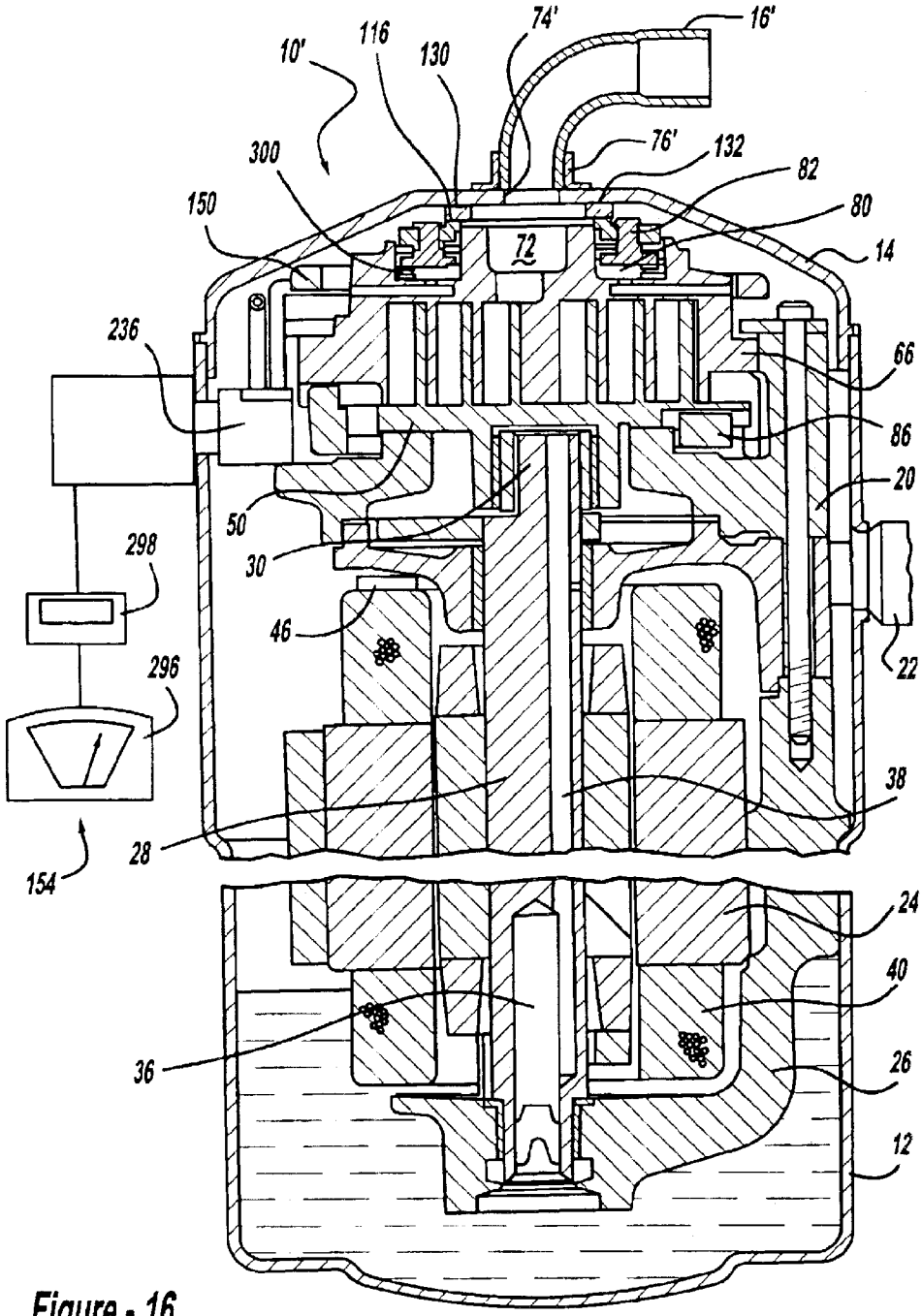
FIG. 16 is a vertical section view of a scroll-type compressor similar to FIG. 1, but incorporating a capacity modulation system in accordance with another embodiment of the present invention.

Referring now to FIG. 16, a scroll compressor 10' is illustrated. Compressor 10' is the same as compressor 10 except that transversely extending partition 18 has-been eliminated and floating seal 82 defines top seal 130, which is now between sealing lip 116 and annular wear ring 132 disposed on end cap 14. In this embodiment, top seal 130 isolates fluid at suction pressure from fluid at discharge pressure across the top of the seal assembly 82 also. Discharge fitting 16' is disposed on end cap 14 over an opening 74' located within end cap 14 to define a direct discharge compressor. An appropriate fitting 76' secures discharge fitting 16' to end cap 14.

The remaining details for compressor 10' are the same as that described above for compressor 10 and, thus, they will not be repeated. The function, operation and advantages described above for compress 10 are the same for compressor 10'.

Figure 17:
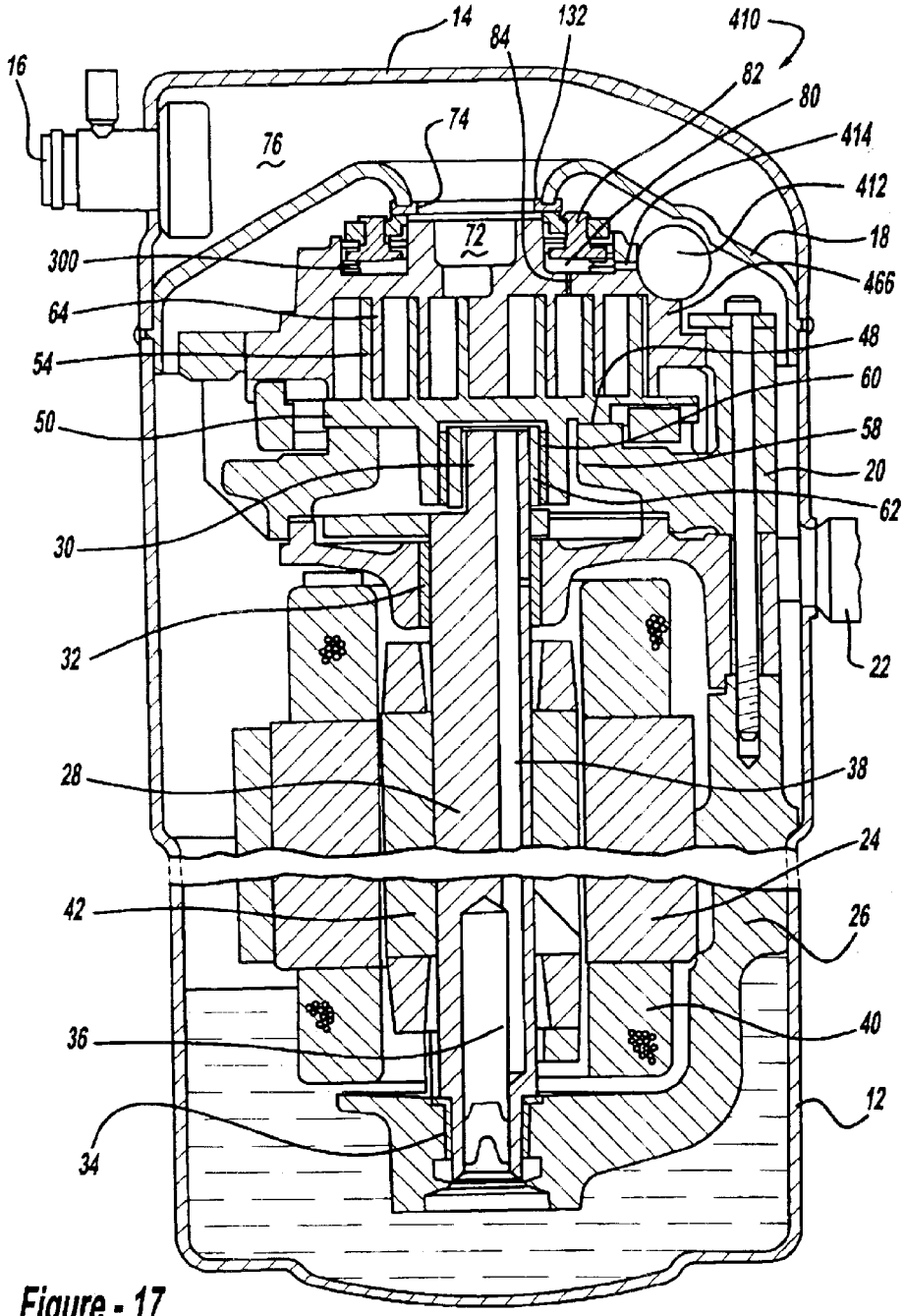
FIG. 17 is a vertical section view of a scroll-type compressor incorporating a capacity modulation system in accordance with another embodiment of the present invention.

Referring now to FIG. 17, a compressor 410 is shown which comprises generally cylindrical hermetic shell 12 having welded at the upper end thereof end cap 14. End cap 14 is provided with refrigerant discharge fitting 16 which may have the usual discharge valve therein (not shown). Other major elements affixed to the shell include inlet fitting 22, transversely extending partition 18 which is welded about its periphery at the same point that end cap 14 is welded to shell 12, two piece main bearing housing 20 and frame 26. Frame 26 locates and supports within shell 12 two piece main bearing housing 20 and motor stator 24. Drive shaft or crankshaft 28 having eccentric crank pin 30 at the upper end thereof is rotatably journaled in bearing 32 in main bearing housing 20 and second bearing 34 in frame 26. Crankshaft 28 has at the lower end relatively large diameter concentric bore 36 which communicates with radially outwardly inclined smaller diameter bore 38 extending upwardly therefrom to the top of crankshaft 28. The lower portion of the interior shell 12 is filled with lubricating oil, and bore 36 acts as a pump to pump lubricating fluid up crankshaft 28 and into bore 38 and ultimately to all of the various portions of the compressor which require lubrication.

Crankshaft 28 is rotatively driven by the electric motor including motor stator 24 windings 40 passing therethrough and motor rotor 42 press fitted on crankshaft 28 and having upper and lower counterweights.

The upper surface of two piece main bearing housing 20 is provided with flat thrust bearing surface 48 on which is disposed orbiting scroll 50 having the usual spiral vane or wrap 54 on the upper surface thereof. Projecting downwardly from the lower surface of orbiting scroll 50 is cylindrical hub 58 having journal bearing 60 therein and in which is rotatively disposed drive bushing 62 having an inner bore in which crank pin 30 is drivingly disposed. Crank pin 30 has a flat on one surface which drivingly engages a flat surface (not shown) formed in a portion of the inner bore of drive bushing 62 to provide a radially compliant driving arrangement. An Oldham coupling is also provided positioned between orbiting scroll 50 and bearing housing 20. The Oldham coupling is keyed to orbiting scroll 50 and a non-orbiting scroll 466 to prevent rotational movement of orbiting scroll member 50.

Non-orbiting scroll member 466 is also provided having wrap 64 positioned in meshing engagement with wrap 54 of orbiting scroll 50. Non-orbiting scroll 466 has a centrally disposed discharge passage which communicates with upwardly open recess 72 which in turn is in fluid communication via opening 74 in partition 18 with discharge muffler chamber 76 defined by end cap 14 and partition 18. Non-orbiting scroll member 466 has in the upper surface thereof annular recess 80 having parallel coaxial sidewalls in which is sealingly disposed for relative axial movement annular floating seal 82 which serves to isolate the bottom of recess 80 from the presence of gas under suction pressure and gas under discharge pressure so that it can be placed in fluid communication with a source of gas at an intermediate fluid pressure by means of passageway 84. Non-orbiting scroll member 466 is thus axially biased against orbiting scroll member 50 to enhance wrap tip sealing by the forces created by discharge pressure acting on the central portion of scroll member 466 and those created by intermediate fluid pressure acting on the bottom of recess 80. Discharge gas is also sealed from gas at suction pressure in shell 12 by means of a seal acting against annular wear ring 132 attached to partition 18. Non-orbiting scroll member 466 is designed to be mounted to bearing housing 20 in a suitable manner which will provide limited axial (and no rotational) movement of non-orbiting scroll member 466.

Compressor 410 is preferably of the "low side" type in which suction gas entering via fitting 22 is allowed, in part, to escape into the shell and assist in cooling the motor. So long as there is an adequate flow of returning suction gas the motor will remain within desired temperature limits. When this flow ceases, however, the loss of cooling will cause a motor protector to trip and shut the machine down.

The valve of the present invention operates to allow gas at intermediate pressure to flow to an area of suction pressure which then allows discharge pressure to dump to suction pressure. By working with gas at intermediate pressure rather than directly with gas at discharge pressure, the size complexity and cost of the valve can be significantly reduced. In one embodiment, the valve is operated by an internal solenoid, and in another embodiment, the valve is operated by an external solenoid. It is believed that all embodiments of the present invention are fully applicable to any type of scroll compressor.

The embodiment of the present invention shown in FIG. 17 makes use of the dual pressure balancing scheme described above to axially balance non-orbiting scroll member 466 with floating seal 82 being used to separate the discharge gas pressure from the suction gas pressure.

A solenoid valve 412 is operable to open and close a passageway 414 located within non-orbiting scroll 466. Passageway 414 extends from the bottom of recess 80 which is at intermediate pressure during operation of compressor 410 to the area of compressor 410 which contains suction gas at suction gas pressure.

In operation, when system operating conditions as sensed by one or more sensors 296 indicate that full capacity of compressor 410 is required, control module 298 will operate in response to a signal from sensors 296 to energize solenoid valve 412 thereby prohibiting passageway 414 from communicating with the suction area of compressor 410, and compressor 410 will operate at full capacity.

When the load conditions change to the point that the full capacity of compressor 410 is not required, sensors 296 will provide a signal indicative thereof to controller 298 which in turn will deenergize solenoid valve 412 thereby placing passageway 414 in communication with the suction area of compressor 410. The intermediate pressure within annular recess 80 will be exhausted or vented through passageway 414 to remove the biasing force urging non-orbiting scroll member 466 into sealing engagement with orbiting scroll member 50. Spring 300 urges floating seal 82 upwards and maintains the sealing relationship at top seal 130. Non-orbiting scroll 466 will be biased away from orbiting scroll member 50 creating a leak between the discharge pressure zone and the suction pressure zone. The leak causes the capacity of compressor 410 to move to zero.

As detailed above, the capacity modulation system can control the capacity of compressor 410 to be 100% capacity or it can be zero. Also, by controlling solenoid valve 412 using a pulsed width modulation system. The capacity of compressor 410 can be set at any point between zero capacity and 100% capacity to provide complete control of compressor 410. Stated differently, pulsed width modulation control of solenoid valve 412 will provide the capacity control for compressor 410 anywhere between 0% and 100% capacity.

Figure 18:
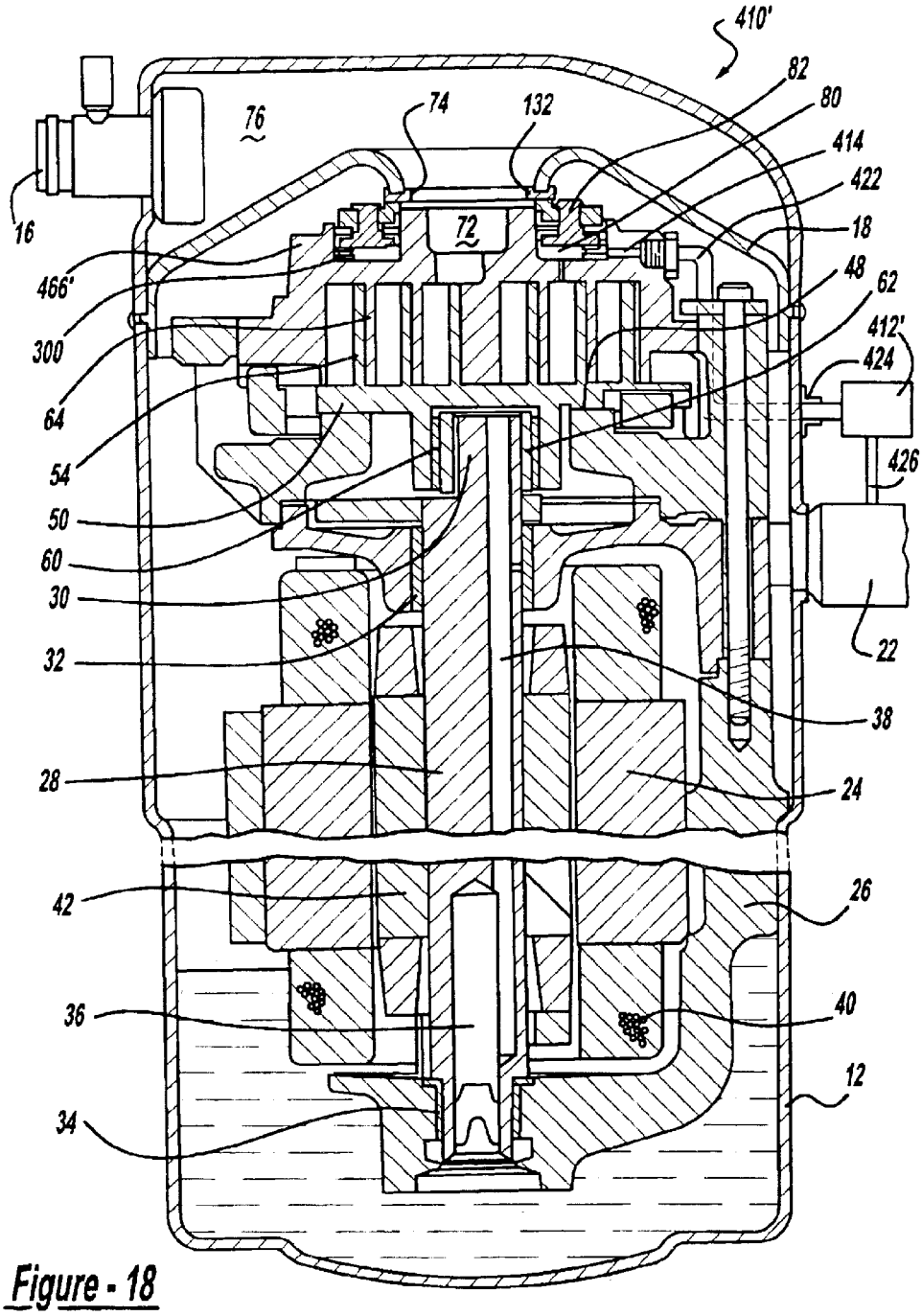
FIG. 18 is a vertical section view similar to FIG. 17 except that the solenoid valve assembly is positioned outside of the shell of the compressor.

Referring now to FIG. 18, a compressor 410' is shown. Compressor 410' is the same as compressor 410 except that solenoid valve 412 has been replaced by solenoid valve 412'. Solenoid valve 412' is located outside of shell 12 as opposed to solenoid valve 412 which is located within shell 12. A fluid pipe 422 extends through a fitting 424 attached to shell 12 to place solenoid valve 412' in communication with recess 80. A fluid pipe 426 extends between solenoid valve 412' and suction inlet fitting 22 to place solenoid valve 412' in communication with the suction pressure zone of compressor 410'. The function and operation of compressor 410' and solenoid valve 412' are the same as described above for compressor 410 and solenoid valve 412.

Figure 19:
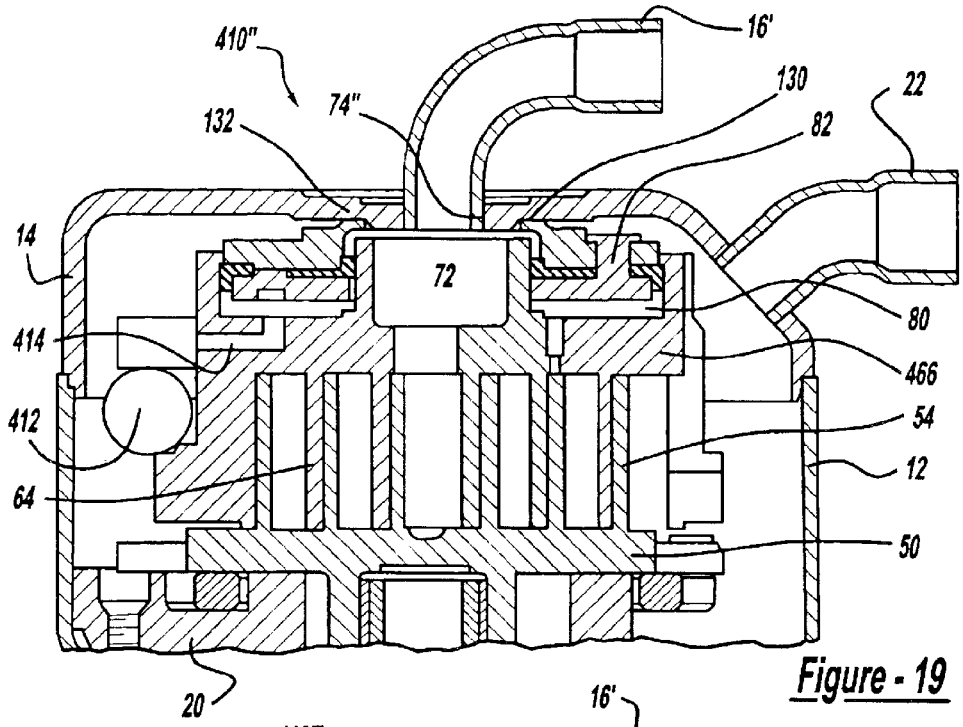
FIG. 19 is a vertical section view of a scroll-type compressor incorporating a capacity modulation system in accordance with another embodiment of the present invention.

Referring now to FIG. 19, a scroll compressor 410" is illustrated. Compressor 410" is the same as compressor 410 except that transversely extending partition 18 has been eliminated and seal 82 defines top seal 130, which is now between sealing lip 116 and annular wear ring 132 disposed on end cap 14. In this embodiment, top seal 130 isolates fluid at suction pressure from fluid at discharge pressure across the top of seal assembly 82 also. Discharge fitting 16' is disposed within end cap 14 through an opening 74" located within end cap 14 to define a direct discharge compressor.

The remaining details for compressor 410" are the same as that described above for compressor 410 and, thus, they will not be repeated. The function, operation and advantages described above for compress 410 are the same for compressor 410".

Figure 20:
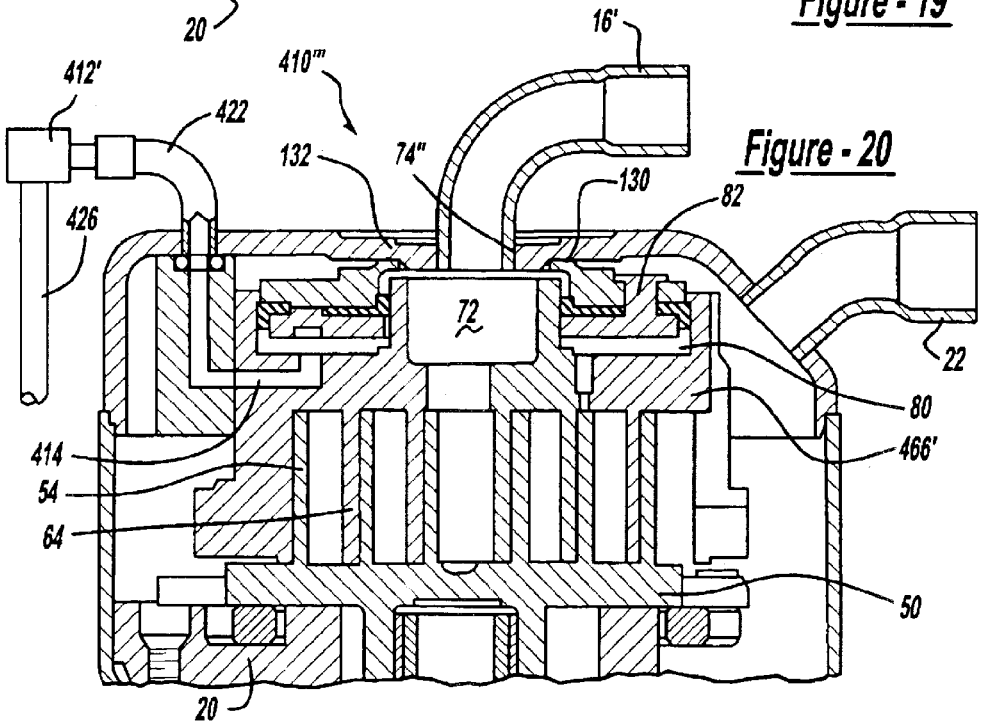
FIG. 20 is a vertical section view similar to FIG. 19 except that the solenoid valve assembly is positioned outside of the shell of the compressor.

Referring now to FIG. 20, a scroll compressor 410'" is illustrated. Compressor 410'" is the same as compressor 410' except that transversely extending partition 18 has been eliminated and seal 82 defines top seal 130, which is now between sealing lip 116 and annular wear ring 132 disposed on end cap 14. In this embodiment, top seal 130 isolates fluid at suction pressure from fluid at discharge pressure across the top of seal assembly 83 also. Discharge fitting 16' is disposed within end cap 14 through an opening 74" located within end cap 14 to define a direct discharge compressor.

The remaining details for compressor 410'" are the same as that described above for compressor 410' and, thus, they will not be repeated. The function, operation and advantages described above for compress 410' and 410 are the same for compressor 410'".

Figure 21:
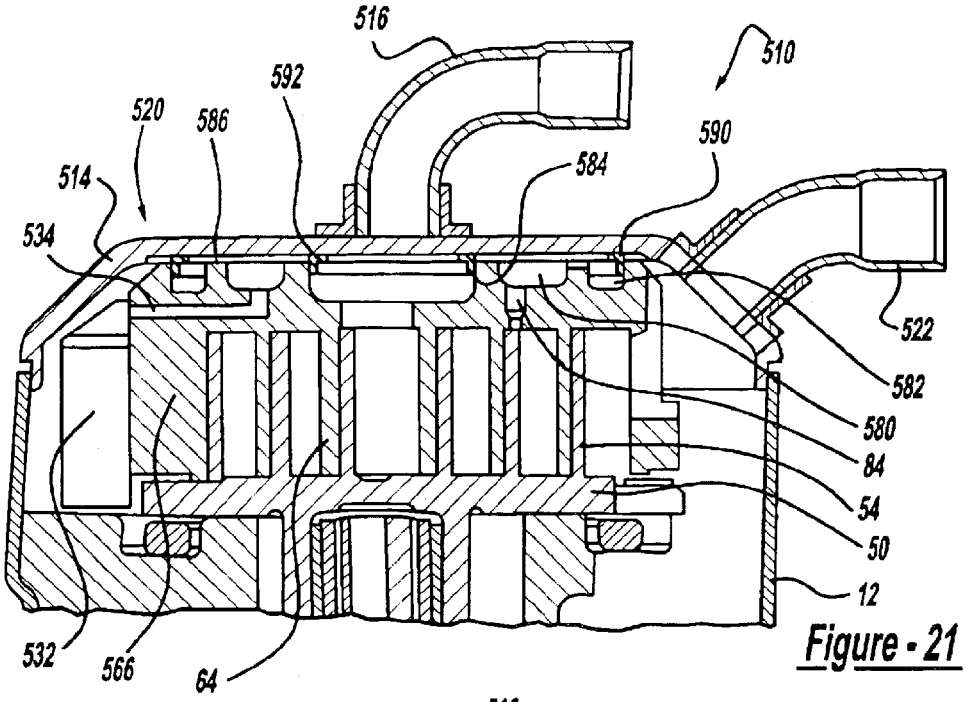
FIG. 21 is a vertical section view of a scroll-type compressor incorporating a capacity modulation system in accordance with another embodiment of the present invention.

Referring now to FIG. 21, a compressor 510 in accordance with another embodiment of the present invention is illustrated. Compressor 510 seals fluid pressure between an end cap 514 and a non-orbiting scroll member 566. A discharge fitting 516 and a suction fitting 522 are secured to end cap 514 to provide for a direct discharge scroll compressor and for providing for the return of the decompressed gas to compressor 510. Non-orbiting scroll member 566 is designed to replace non-orbiting scroll member 66 or any other of the non-orbiting scroll members described above.

As shown in FIG. 21, a partition between the suction pressure zone and the discharge pressure zone of compressor 510 has been eliminated due to a sealing system 520 being disposed between end cap 514 and non-orbiting scroll member 566.

Non-orbiting scroll member 566 includes scroll wrap 64 and it defines an annular recess 580, an outer seal groove 582 and an inner seal groove 584. A passage 586 interconnects annular recess 580 with outer seal groove 582. Annular chamber 580 is located between outer seal groove 582 and inner seal groove 584 and it is provided compressed fluid through a fluid passage 84 which opens to a fluid pocket defined by non-orbiting scroll wrap 64 of non-orbiting scroll member 566 and orbiting scroll wrap 54 of orbiting scroll member 50. The pressurized fluid provided through fluid passage 84 is at a pressure which is intermediate or in between the suction pressure and the discharge pressure of the compressor. The fluid pressure within annular chamber 580 biases non-orbiting scroll member 566 towards orbiting scroll member 50 to enhance the tip sealing characteristics between the two scroll members.

A flip seal 590 is disposed within outer seal groove 582 and a flip seal 592 is disposed within inner seal groove 584. Flip seal 590 sealing engages non-orbiting scroll member 566 and end cap 514 to isolate annular recesses 580 from suction pressure. Flip seal 592 sealingly engages non-orbiting scroll member 566 and end cap 514 to isolate annular recesses 580 from discharge pressure.

Similar to the embodiments described above, compressor 510 makes use of the dual pressure balancing scheme described above to axially balance non-orbiting scroll member 566 without the use of a floating seal to separate the discharge gas pressure from the suction gas pressure.

A solenoid valve 532 is operable to open and close a passageway 534 located within non-orbiting scroll member 566. Passageway 534 extends from the bottom of annular chamber 580 which is at intermediate pressure during operation of compressor 510 to an area of compressor 510 which contains suction gas at suction gas pressure.

In operation, when system operating conditions as sensed by one or more sensors 296 indicate that full capacity of compressor 510 is required, control module 298 will operate in response to a signal from sensors 296 to energize solenoid valve 532 thereby prohibiting passageway 534 from communicating with the suction area of compressor 510 and compressor 510 will operate at full capacity.

When the load conditions change to the point that full capacity of compressor 510 is not required, sensors 296 will provide a signal indicative thereof to controller 298 which in turn will deenergize solenoid valve 532 thereby placing passageway 534 in communication with the suction area of compressor 510. The intermediate pressure within annular chamber 580 will be exhausted or vented through passageway 534 to remove the biasing force urging non-orbiting scroll member 566 into sealing engagement with orbiting scroll member 50. Non-orbiting scroll member 566 will be biased away from orbiting scroll member 50 creating a leak between the discharge pressure zone and the suction pressure zone. This leak causes the capacity of compressor 510 to move to zero.

As detailed above, the capacity modulation system can control the capacity of compressor 510 to be 100% capacity or it can be zero. Also, by controlling solenoid valve 532 using a pulsed width modulation system, the capacity of compressor 510 can be set at any point between zero capacity and 100% capacity to provide complete control of compressor 510. Stated differently, pulsed width modulation control of solenoid valve 532 will provide the capacity control for compressor 510 anywhere between 0% and 100% capacity.

Figure 22:
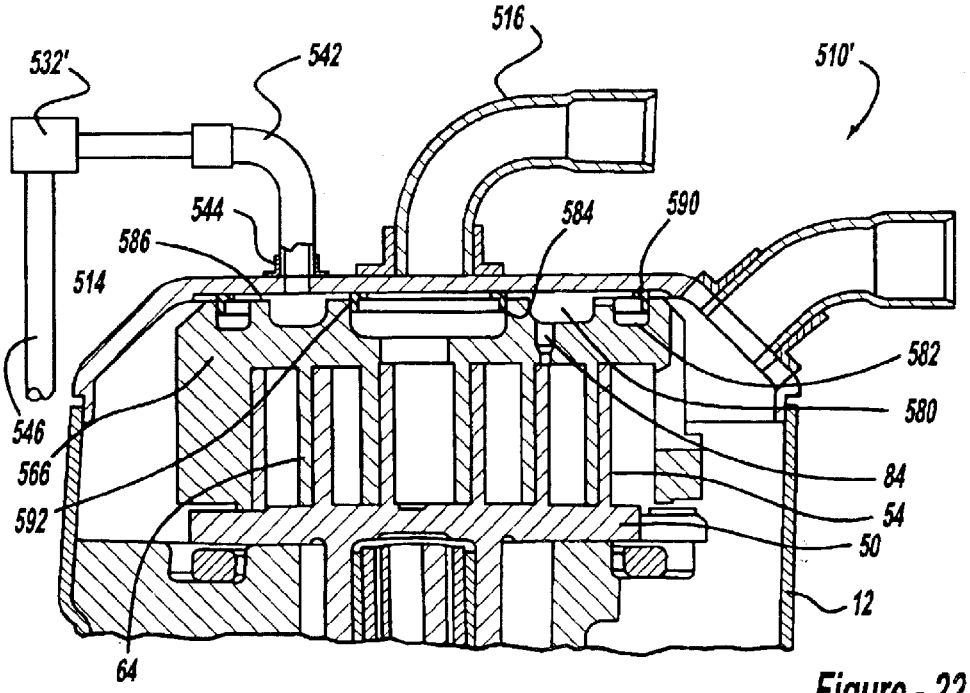
FIG. 22 is a vertical section view similar to FIG. 21 except that the solenoid valve assembly is positioned outside of the shell of the compressor.

Referring now to FIG. 22, a compressor 510' is shown. Compressor 510' is the same as compressor 510 except that solenoid valve 532 has been replaced by solenoid valve 532'. Solenoid valve 532' is located outside of shell 12 as opposed to solenoid valve 532 which is located within shell 12. A fluid pipe 542 extends through a fitting 544 attached to end cap 514 to place solenoid valve 532' in communication with annular chamber 580. A fluid pipe 546 extends between solenoid valve 532' and suction inlet fitting 522 or is otherwise connected to the suction chamber of compressor 510' to place solenoid valve 532' in communication with the suction pressure zone of compressor 510'. The function and operation of compressor 510' and solenoid valve 532' are the same as described above for compressor 510 and solenoid valve 532.

Figure 23:
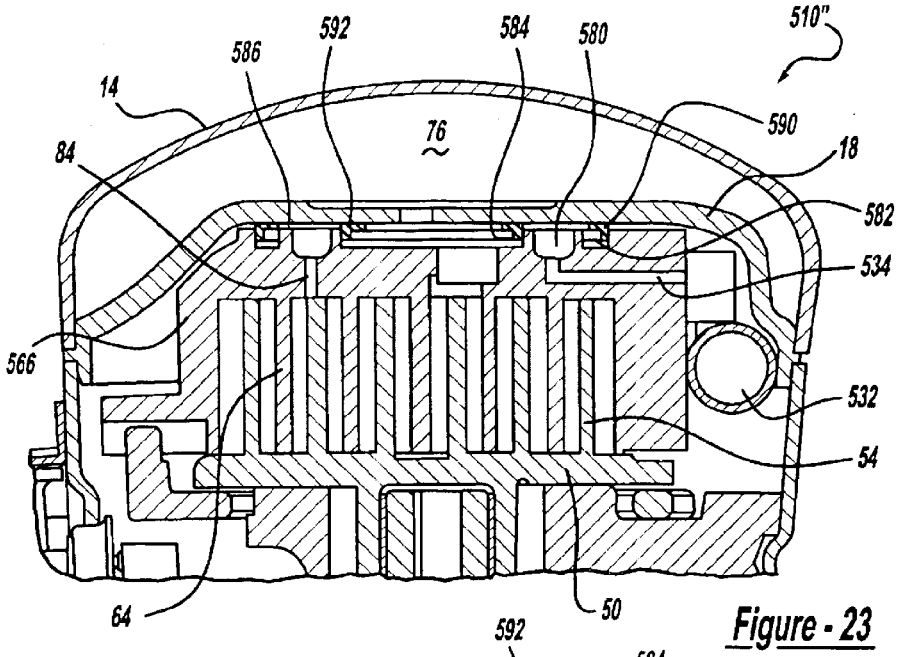
FIG. 23 is a vertical section view of a scroll-type compressor incorporating a capacity modulation system in accordance with another embodiment of the present invention.

Referring now to FIG. 23, a scroll compressor 510" is illustrated. Compressor 510" is the same as compressor 510 except that transversely extending partition 18 has been added to define discharge muffler chamber 76 for compressor 510". Flip seal 590 sealingly engages non-orbiting scroll member 566 and partition 18 to isolate annular recess 580 from suction pressure; while flip seal 592 sealingly engages non-orbiting scroll member 566 and partition 18 to isolate annular recess 580 from discharge pressure. Discharge fitting 16 (not shown in FIG. 23) is secured to end cap 14 similar to that illustrated in FIG. 1.

The remaining details for compressor 510" are the same as that described above for compressor 510 and, thus, they will not be repeated here. The function, operation and advantages described above for compressor 510 are the same for compressor 510".

Figure 24:
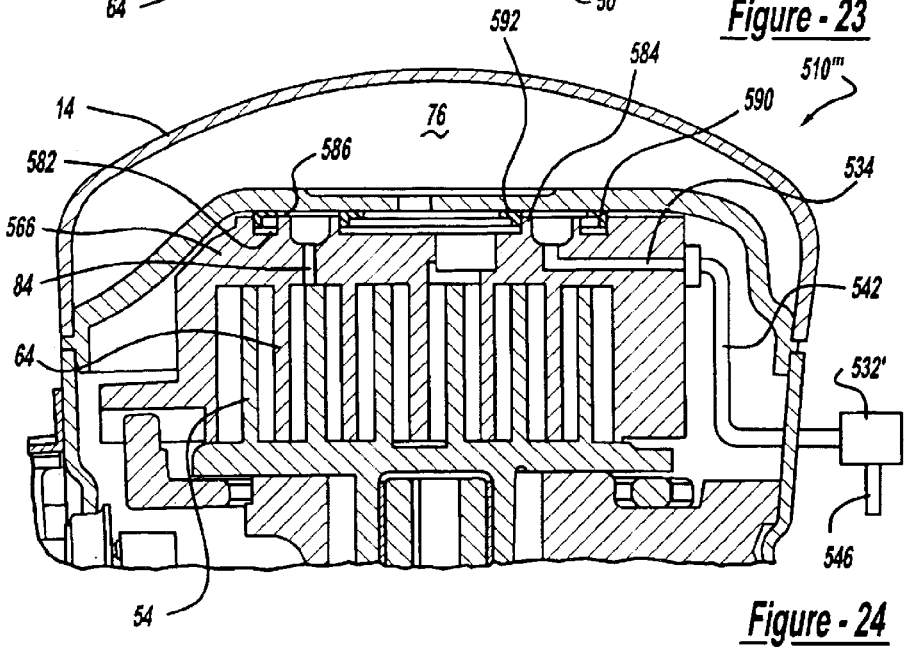
FIG. 24 is a vertical section view similar to FIG. 23 except that the solenoid valve assembly is positioned outside the shell of the compressor.

Referring now to FIG. 24, a compressor 510'" is illustrated. Compressor 510'" is the same as compressor 510' except that transversely extending partition 18 has been added to define discharge muffler chamber 76 for compressor 510'" similar to that described above for compressor 510". Flip seal 590 sealingly engages non-orbiting scroll member 566 and partition 18 to isolate annular recess 580 from suction pressure; while flip seal 592 sealingly engages non-orbiting scroll member 566 and partition 18 to isolate annular recess 580 from discharge pressure. Discharge fitting 16 (not shown in FIG. 24) is secured to end cap 14 similar to that illustrated in FIG. 1.

The remaining details for compressor 510'" are the same as that described above for compressors 510' and 510 and, thus, they will not be repeated here. The function, operation and advantages described above for compressors 510' and 510 are the same for compressor 510'".

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A scroll machine comprising:

a first scroll member having a first spiral wrap projecting outwardly from a first end plate, said first scroll member defining a recess;

a second scroll member having a second spiral scroll wrap projecting outwardly from a second end plate, said second spiral wrap being intermeshed with said first spiral wrap, said first scroll member being mounted for limited axial movement with respect to said second scroll member, said first scroll member being biased toward said second scroll member by a pressurized fluid disposed within said recess;

a drive member for causing said scroll members to orbit relating to one another whereby said spiral wraps will create pockets of progressively changing volume between a suction pressure zone at suction pressure and a discharge pressure zone at discharge pressure;

a seal disposed within said recess, said seal being biased toward a component of said scroll machine by said pressurized fluid to close a first leakage path extending between said discharge pressure zone and said suction pressure zone;

a valve assembly for releasing said pressurized fluid whereby said first scroll member will move axially with respect to said second scroll member to open a second leakage path between said suction pressure zone and said discharge pressure zone.

2. The scroll machine according to claim 1 wherein said pressurized fluid is released to said suction pressure zone of said scroll machine.

3. The scroll machine according to claim 1 wherein said valve assembly is a solenoid valve.

4. The scroll machine according to claim 3 wherein said solenoid valve is operated in a pulsed manner to modulate the capacity of said scroll machine.

5. The scroll machine according to claim 1 wherein said pressurized fluid is at a pressure between said suction pressure and said discharge pressure.

6. The scroll machine according to claim 1 wherein said scroll machine further comprises a shell, said first and second scroll members being disposed within said shell.

7. The scroll machine according to claim 6 wherein said valve assembly is disposed outside of said shell.

8. The scroll machine according to claim 7 wherein said valve assembly is attached to said shell.

9. The scroll machine according to claim 7 wherein said scroll machine further comprises a suction gas inlet, said valve assembly being attached to said suction gas inlet.

10. The scroll machine according to claim 7 further comprising a tube extending through said shell, said tube fluidically connecting said recess and said valve assembly.

11. The scroll machine according to claim 10 wherein said first scroll member defines a passage between said recess and said tube.

12. The scroll machine according to claim 6 wherein said valve assembly is disposed within said shell.

13. The scroll machine according to claim 12 wherein said valve assembly is attached to said first scroll member.

14. The scroll machine according to claim 13 wherein said first scroll member defines a passage between said recess and said valve assembly.

15. The scroll machine according to claim 1 wherein said valve assembly includes a ring rotatably disposed on said first scroll member.

16. The scroll machine according to claim 15 further comprising a linear actuator for rotating said ring.

17. The scroll machine according to claim 15 further comprising a valve member for rotating said ring.

18. The scroll machine according to claim 17 wherein said valve member is a solenoid valve.

19. The scroll machine according to claim 18 wherein said solenoid valve is operated in a pulsed manner to modulate the capacity of the scroll machine.

20. The scroll machine according to claim 1 wherein said seal comprises a lip seal in engagement with said first scroll member.

21. The scroll machine according to claim 1 further comprising a shell, said first and second scroll members being disposed within said shell, said seal comprising a lip seal in engagement with said shell.

22. The scroll machine according to claim 21 wherein said shell includes an end cap, said lip seal being in engagement with said end cap.

23. The scroll machine according to claim 1 further comprising a partition separating said suction pressure zone from said discharge pressure zone and a lip seal in engagement with said partition.

24. The scroll machine according to claim 1 wherein said component is a shell, said first and second scroll members being disposed within said shell.

25. The scroll machine according to claim 24 wherein said shell includes an end cap, said component being said end cap of said shell.

26. The scroll machine according to claim 1 wherein said component is a partition separating said suction pressure zone from said discharge pressure zone.

27. A scroll machine comprising:

a first scroll member having a first spiral wrap projecting outwardly from a first end plate, said first scroll member defining a recess;

a second scroll member having a second spiral wrap projecting outwardly from a second end plate, said second spiral wrap being intermeshed with said first spiral wrap, said first scroll member being mounted for limited axial movement with respect to said second scroll member, said first scroll member being biased toward said second scroll member by a pressurized fluid disposed within said recess;

a drive member for causing said scroll members to orbit relative to one another whereby said spiral wraps will create pockets of progressively changing volume between a suction pressure zone at suction pressure and a discharge pressure zone at discharge pressure;

a first lip seal disposed between said first scroll member and a component of said scroll machine, said first lip seal isolating said recess from said discharge pressure zone;

a second lip seal disposed between said first scroll member and said component of said scroll machine, said second lip seal isolating said recess from said suction pressure zone;

a valve assembly for releasing said pressurized fluid whereby said first scroll member will move axially with respect to said second scroll member to open a leakage path between said suction pressure zone and said discharge pressure zone.

28. The scroll machine according to claim 27 wherein said component is a shell, said first and second scroll members being disposed within said shell.

29. The scroll machine according to claim 28 wherein said pressurized fluid is at a pressure between said suction pressure and said discharge pressure.

30. The scroll machine according to claim 27 wherein said pressurized fluid is released to said suction pressure zone of said scroll machine.

31. The scroll machine according to claim 27 wherein said valve assembly is a solenoid valve.

32. The scroll machine according to claim 31 wherein said solenoid valve is operated in a pulsed manner to modulate the capacity of said scroll machine.

33. The scroll machine according to claim 27 wherein said scroll machine further comprises a shell, said first and second scroll members being disposed within said shell.

34. The scroll machine according to claim 33 wherein said valve assembly is disposed outside of said shell.

35. The scroll machine according to claim 34 wherein said valve assembly is attached to said shell.

36. The scroll machine according to claim 34 wherein said scroll machine further comprises a suction gas inlet, said valve assembly being attached to said suction gas inlet.

37. The scroll machine according to claim 34 further comprising a tube extending through said shell, said tube fluidically connecting said recess and said valve assembly.

38. The scroll machine according to claim 37 wherein said first scroll member defines a passage between said recess and said tube.

39. The scroll machine according to claim 33 wherein said valve assembly is disposed within said shell.

40. The scroll machine according to claim 39 wherein said valve assembly is attached to said first scroll member.

41. The scroll machine according to claim 40 wherein said first scroll member defines a passage between said recess and said valve member.

42. The scroll machine according to claim 27 wherein said component is an end cap of a shell, said first and second scroll members being disposed within said shell.

43. The scroll machine according to claim 27 wherein said component is a partition separating said suction pressure zone from said discharge pressure zone.

44. A machine comprising:

a housing;

a first scroll member disposed in said housing;

a second scroll member disposed in said housing and cooperating with said first scroll member to create pockets of progressively changing volume between a suction pressure zone at suction pressure and a discharge pressure zone at discharge pressure, said second scroll member defining a recess, being mounted for limited axial movement with respect to said first scroll member, and being biased toward said first scroll member by a pressurized fluid disposed within said recess;

a seal disposed within said recess and cooperating with a component of said scroll machine to selectively close a first leakage path extending between said discharge pressure zone and said suction pressure zone, said pressurized fluid biasing said seal into engagement with said component; and a valve assembly associated with said recess and operable to release said pressurized fluid, wherein said second scroll member moves relative to said first scroll member to define a second leakage path between said suction pressure zone and said discharge pressure zone.

45. The machine according to claim 44 wherein said valve assembly includes a valve operable in a pulsed manner to modulate the capacity of said scroll machine.

46. The machine according to claim 44 wherein said pressurized fluid is at a pressure between said suction pressure and said discharge pressure.

47. The machine according to claim 44 wherein said valve assembly is disposed outside of said housing.

48. The machine according to claim 44 wherein said valve assembly is attached to said housing.

49. The machine according to claim 44 further comprising a suction gas inlet through said housing, said valve assembly being attached to said suction gas inlet.

50. The machine according to claim 44 wherein said valve assembly is disposed within said housing.

51. The machine according to claim 50 wherein said valve assembly is attached to said second scroll member.

52. The machine according to claim 51 wherein said second scroll member includes a passage between said recess and said valve assembly.

53. The machine according to claim 44 wherein said valve assembly includes a ring rotatably disposed on said second scroll member.

54. The machine according to claim 53 further comprising a linear actuator operable to rotate said ring.

55. The machine according to claim 53 further comprising a valve member operable to rotate said ring.

56. The machine according to claim 55 wherein said valve member is a solenoid valve.

57. The machine according to claim 56 wherein said solenoid valve is operable in a pulsed manner to modulate the capacity of the machine.

58. The machine according to claim 44 wherein said seal includes a lip seal operable to engage said second scroll member.

59. The machine according to claim 44 wherein said seal includes a lip seal operable to engage said housing.

60. The machine according to claim 44 wherein said housing includes an end cap and said seal includes a lip seal operable to engage said end cap.

61. The machine according to claim 44 further comprising a partition separating said suction pressure zone from said discharge pressure zone, and said seal includes a lip seal operable to engage said partition.

62. The machine according to claim 44 wherein said component is said housing.

63. The machine according to claim 44 wherein said housing includes an end cap, said component being said end cap.

64. The machine according to claim 44 further comprising a partition separating said suction pressure zone from said discharge pressure zone, said component being said partition.

65. A machine comprising:

a housing;

a first scroll member disposed in said housing;

a second scroll member disposed in said housing and cooperating with said first scroll member to create pockets of progressively changing volume between a suction pressure zone at suction pressure and a discharge pressure zone at discharge pressure, said second scroll member defining a recess, being mounted for limited axial movement with respect to said first scroll member, and being biased toward said first scroll member by a pressurized fluid disposed within said recess;

a first lip seal disposed between said second scroll member and a component of the machine, said first lip seal isolating said recess from said discharge pressure zone;

a second lip seal disposed between said second scroll member and said component of the machine, said second lip seal isolating said recess from said suction pressure zone;

a valve assembly associated with said recess and operable to release said pressurized fluid, wherein said second scroll member moves relative to said first scroll member to define a leakage path between said suction pressure zone and said discharge pressure zone.

66. The machine according to claim 65 wherein said component is a part of said housing.

67. The machine according to claim 65 wherein said pressurized fluid is at a pressure between said suction pressure and said discharge pressure.

68. The machine according to claim 65 wherein said valve assembly includes a valve operable in a pulsed manner to modulate the capacity of said scroll machine.

69. The machine according to claim 65 wherein said valve assembly is disposed outside of said housing.

70. The machine according to claim 65 wherein said valve assembly is attached to said housing.

71. The scroll machine according to claim 65 further comprising a suction gas inlet through said housing, said valve assembly being attached to said suction gas inlet.

72. The scroll machine according to claim 65 wherein said valve assembly is disposed within said shell.

73. The scroll machine according to claim 65 wherein said valve assembly is attached to said first scroll member.

74. The scroll machine according to claim 65 wherein said first scroll member defines a passage between said recess and said valve assembly.

75. The scroll machine according to claim 65 wherein said component is an end cap of said housing.

76. The scroll machine according to claim 65 wherein said component is a partition separating said suction pressure zone from said discharge pressure zone.

* * * * *

UNITED STATES PATENT AND TRADEMARK OFFICE

CERTIFICATE OF CORRECTION

PATENT NO. : 6,821,092 B1
DATED : November 23, 2004
INVENTOR(S) : Natalie Gehret and Kirill Ignatiev It is certified that error appears in the above-identified patent and that said Letters Patent is hereby corrected as shown below:

Column 1,
Line 7, after “present” insert -- invention --.

Column 2,
Line 24, “compress” should be -- compressor --.
Line 26, “:” should be -- ; --.

Column 4,
Line 63, “FIG. 2. Although” should be -- FIG. 2, although --.

Column 5,
Line 52, “top” should be -- to --.

Column 6,
Line 14, “an” should be -- and --.

Column 7,
Line 42, “references” should be -- reference --.

Column 8,
Line 43, “232 thereafter,” should be -- 232. Thereafter, --.
Line 55, “4 these” should be -- 4. These --.

Column 9,
Line 11, “indicate” should be -- indicative --.
Line 36, “compression” should be -- compressor --.

Column 11,
Line 1, “has-been” should be -- has been --.
Line 14, “compress” should be -- compressor --.

Column 13,
Line 7, “system. The” should be -- system, the --.
Line 41, “compress” should be -- compressor --.
Line 50, “83” should be -- 82 --.
Line 56, “compress” should be -- compressor --.

UNITED STATES PATENT AND TRADEMARK OFFICE

CERTIFICATE OF CORRECTION

PATENT NO. : 6,821,092 B1
DATED : November 23, 2004
INVENTOR(S) : Natalie Gehret and Kirill Ignatiev It is certified that error appears in the above-identified patent and that said Letters Patent is hereby corrected as shown below:

Column 14,
Line 24, “sealing” should be -- sealingly --.

Signed and Sealed this

Twelfth Day of July, 2005

JON W. DUDAS
*Director of the United States Patent and Trademark Office*